US010655869B2

(12) United States Patent
Verhoeven

(10) Patent No.: US 10,655,869 B2
(45) Date of Patent: May 19, 2020

(54) IN-WALL DEHUMIDIFIER CONTROL SYSTEM

(71) Applicant: Therma-Stor LLC, Madison, WI (US)

(72) Inventor: Jerome Verhoeven, Sun Prairie, WI (US)

(73) Assignee: Therma-Stor LLC, Madison, WI (US)

( * ) Notice: Subject to any disclaimer, the term of this patent is extended or adjusted under 35 U.S.C. 154(b) by 71 days.

(21) Appl. No.: 16/005,876

(22) Filed: Jun. 12, 2018

(65) Prior Publication Data

US 2019/0376700 A1 Dec. 12, 2019

(51) Int. Cl.

| | |
|---|---|
| ***F24F 3/14*** | (2006.01) |
| ***F24F 11/41*** | (2018.01) |
| *F25D 21/00* | (2006.01) |
| *F24F 1/0057* | (2019.01) |

(52) U.S. Cl.

CPC ..... *F24F 3/14* (2013.01); *F24F 11/41* (2018.01); *F24F 1/0057* (2019.02); *F25B 2700/2117* (2013.01); *F25D 21/006* (2013.01)

(58) Field of Classification Search

CPC . F24F 1/0057; F24F 3/14; F24F 11/41; F25B 2700/2117; F25D 21/006

See application file for complete search history.

(56) References Cited

U.S. PATENT DOCUMENTS

| | | | | |
|---|---|---|---|---|
| 4,302,947 | A | 12/1981 | Mueller | |
| 4,328,680 | A | 5/1982 | Stamp, Jr. et al. | |
| 4,344,294 | A | 8/1982 | Gelbard | |
| 4,627,245 | A | 12/1986 | Levine | |
| 4,646,529 | A | 3/1987 | Hanson | |
| 4,680,940 | A | 7/1987 | Vaughn | |
| 4,745,766 | A | 5/1988 | Bahr | |
| 5,493,870 | A | 2/1996 | Kodama et al. | |
| 5,553,462 | A | 9/1996 | Taylor | |
| 6,490,876 | B2 | 12/2002 | Derryberry et al. | |
| 2001/0045098 | A1* | 11/2001 | Derryberry | F24F 3/14 62/139 |
| 2014/0096553 | A1* | 4/2014 | Satou | F25B 49/022 62/180 |

FOREIGN PATENT DOCUMENTS

| | | |
|---|---|---|
| EP | 1 510 768 A1 | 3/2005 |
| GB | 1015727 A | 1/1966 |

* cited by examiner

*Primary Examiner* — Marc E Norman

(74) *Attorney, Agent, or Firm* — Baker Botts L.L.P.

(57) ABSTRACT

A method of controlling an in-wall dehumidifier is disclosed. The method includes setting the dehumidifier to a defrost mode if the dehumidifier has been operating in a dehumidifying mode for less than a predetermined amount of time and a measured evaporator coil temperature is less than a first evaporator coil temperature set point. The method further includes setting the dehumidifier to the defrost mode if the dehumidifier has been operating in the dehumidifying mode for equal to or greater than the predetermined amount of time and a measured evaporator coil temperature is less than a second evaporator coil temperature set point that is higher than the first evaporator coil temperature set point.

19 Claims, 18 Drawing Sheets

IN-WALL DEHUMIDIFIER CONTROL SYSTEM

TECHNICAL FIELD

This invention relates generally to dehumidification and more particularly to an in-wall dehumidifier control system.

BACKGROUND OF THE INVENTION

In certain situations, it is desirable to reduce the humidity of air within a structure. For example, homes and apartments may need dehumidification during certain times of the year to reduce the moisture levels within the living spaces. To accomplish this, one or more dehumidifiers may be placed within the structure to dehumidify the air. Current dehumidifiers, however, are typically bulky and require valuable floor space.

SUMMARY OF THE INVENTION

According to embodiments of the present disclosure, disadvantages and problems associated with previous dehumidification systems may be reduced or eliminated.

In some embodiments, a dehumidifier includes a cabinet configured to be installed between studs in a wall and an air diffuser configured to diffuse an airflow from the dehumidifier along a surface of the wall. The air diffuser includes an inlet, an outlet above the inlet, and a divider between the inlet and outlet. The divider is configured to prevent the airflow entering the cabinet through the inlet from mixing with the airflow exiting the cabinet from the outlet. The dehumidifier further includes a compressor, an evaporator installed within the cabinet above the compressor, and a condenser installed within the cabinet above the evaporator. The condenser includes a plurality of microchannel condenser coils. The dehumidifier further includes a fan installed between the evaporator and a back surface of the cabinet. The fan is configured to generate the airflow that flows into the cabinet through the inlet of the air diffuser and out of the cabinet through the outlet of the air diffuser. The airflow flows through the evaporator and condenser in order to provide dehumidification to the airflow. The dehumidifier further includes a drain pan installed within the cabinet below the evaporator. The drain pan is configured to capture water removed from the airflow by the evaporator. The drain pan includes a notch and a tab configured to direct an overflow from the drain pan to a front face of the cabinet, thereby causing the overflow to be visible when the dehumidifier is installed in the wall. The dehumidifier further includes a sensor installed below the drain pan. The sensor is configured to sense one or more environmental conditions of a bypass portion of the airflow.

In some embodiments, a dehumidifier includes a cabinet configured to be installed between studs in a wall, an air diffuser configured to diffuse an airflow from the dehumidifier along a surface of the wall, a compressor, an evaporator installed within the cabinet above the compressor, a condenser installed within the cabinet above the evaporator, and a fan. The fan is installed between the evaporator and a back surface of the cabinet. The fan is configured to generate the airflow that flows into the cabinet through an inlet of the air diffuser and out of the cabinet through an outlet of the air diffuser. The airflow flows through the evaporator and condenser in order to provide dehumidification to the airflow.

In certain embodiments, a dehumidifier includes a cabinet configured to be installed between studs in a wall, a compressor, an evaporator installed within the cabinet above the compressor, a condenser installed within the cabinet above the evaporator, and a fan installed between the evaporator and a back surface of the cabinet. The fan is configured to generate the airflow that flows into the cabinet through the evaporator and out of the cabinet through condenser. The airflow flows through the evaporator and condenser in order to provide dehumidification to the airflow.

In some embodiments, a method includes determining, by a dehumidifier, a first evaporator coil temperature set point and a second evaporator coil temperature set point, wherein the first evaporator coil temperature set point is lower than the second evaporator coil temperature set point. The method further includes determining, by the dehumidifier, whether the dehumidifier has been operating in a dehumidifying mode for less than a predetermined amount of time. The method further includes comparing, by the dehumidifier, a first measured evaporator coil temperature to the first evaporator coil temperature set point in response to determining that the dehumidifier has been operating in the dehumidifying mode for less than the predetermined amount of time. The method further includes setting, by the dehumidifier, the dehumidifier to a defrost mode in response to determining that the first measured evaporator coil temperature is less than the first evaporator coil temperature set point. The method further includes determining, by the dehumidifier, whether a second measured evaporator coil temperature is less than the second evaporator coil temperature set point in response to determining that the dehumidifier has been operating in the dehumidifying mode for equal to or greater than the predetermined amount of time. The method further includes setting, by the dehumidifier, the dehumidifier to the defrost mode in response to determining that the second measured evaporator coil temperature is less than the second evaporator coil temperature set point.

Certain embodiments of the present disclosure may provide one or more technical advantages. For example, certain embodiments provide an in-wall dehumidifier that may be installed within existing spaces between wall studs. This reduces or eliminates the amount of living space required for the dehumidifier. Some embodiments may be blindly installed (i.e., installed while only requiring access from one side of a wall) within typically-spaced 2×4 or 2×6 wall studs. This reduces the installation time, cost, and complexity over existing systems. Some embodiments include innovative air diffusers and arrangements of internal components to provide indirect airflow into living spaces, thereby reducing undesirable drafts caused by typical dehumidifiers.

Certain embodiments of the present disclosure may include some, all, or none of the above advantages. One or more other technical advantages may be readily apparent to those skilled in the art from the figures, descriptions, and claims included herein.

BRIEF DESCRIPTION OF THE DRAWINGS

To provide a more complete understanding of the present invention and the features and advantages thereof, reference is made to the following description taken in conjunction with the accompanying drawings, in which.

DETAILED DESCRIPTION OF THE DRAWINGS

In certain situations, it is desirable to reduce the humidity of air within a structure. For example, homes and apartments may need dehumidification during certain times of the year to reduce the moisture levels within the living spaces. To accomplish this, one or more dehumidifiers may be placed within the structure to dehumidify the air. Current dehumidifiers, however, are typically bulky and require valuable floor space.

Figure 1:
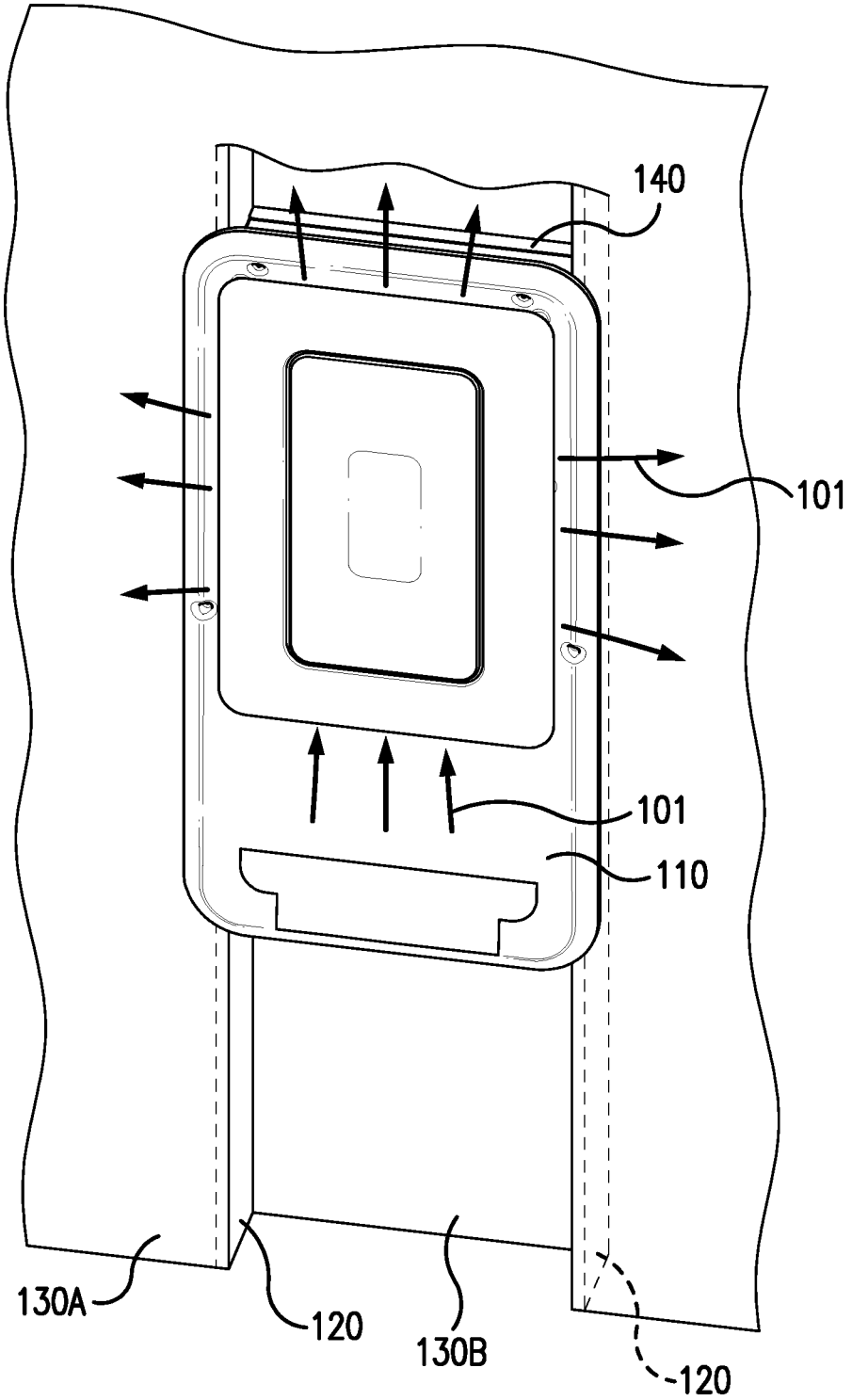
FIG. 1 illustrates an in-wall dehumidifier installed between typical wall studs, according to certain embodiments.
Figure 2A:
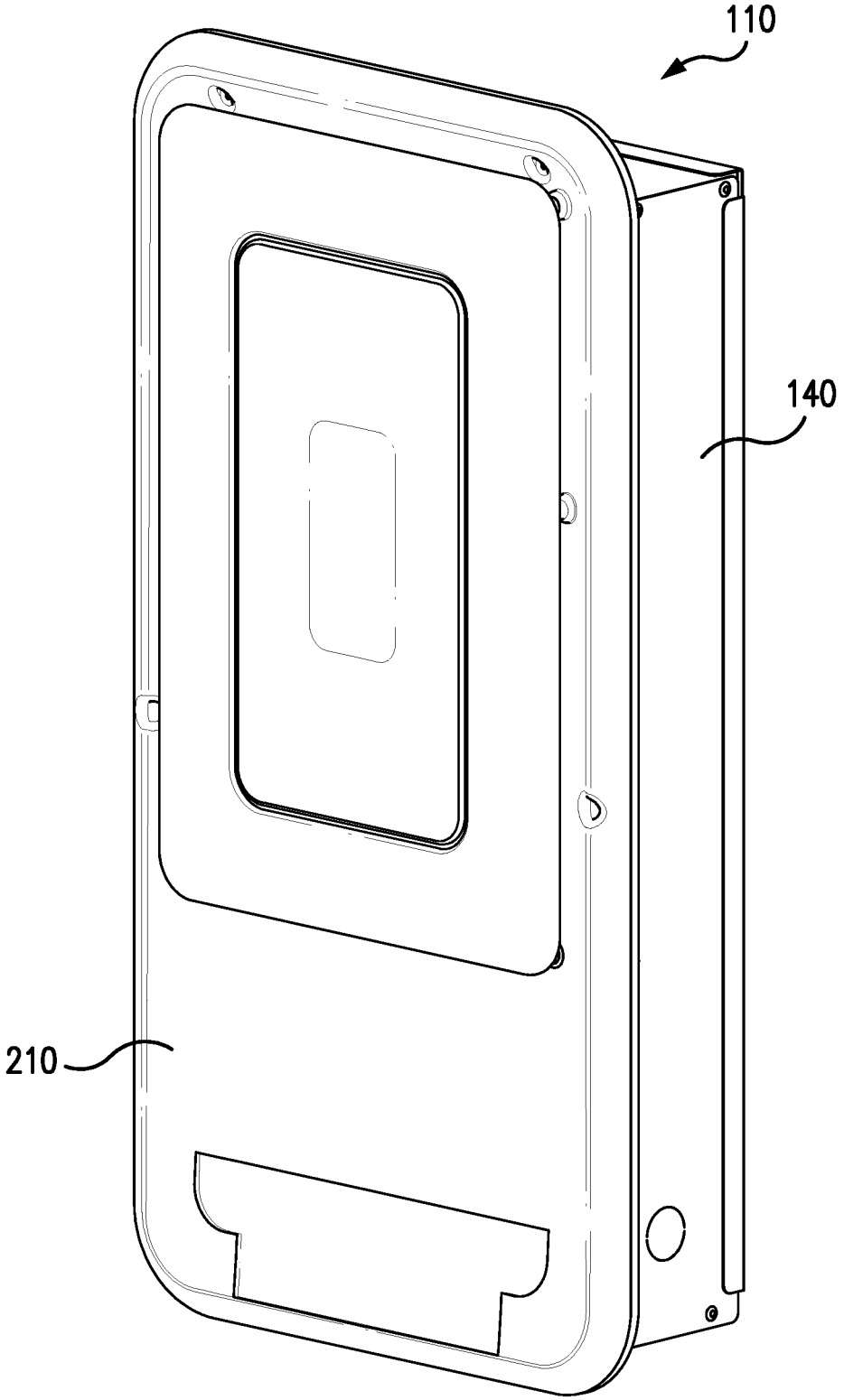
FIGS. 2A-2B illustrate perspective views of the in-wall dehumidifier of FIG. 1, according to certain embodiments.
Figure 2B:
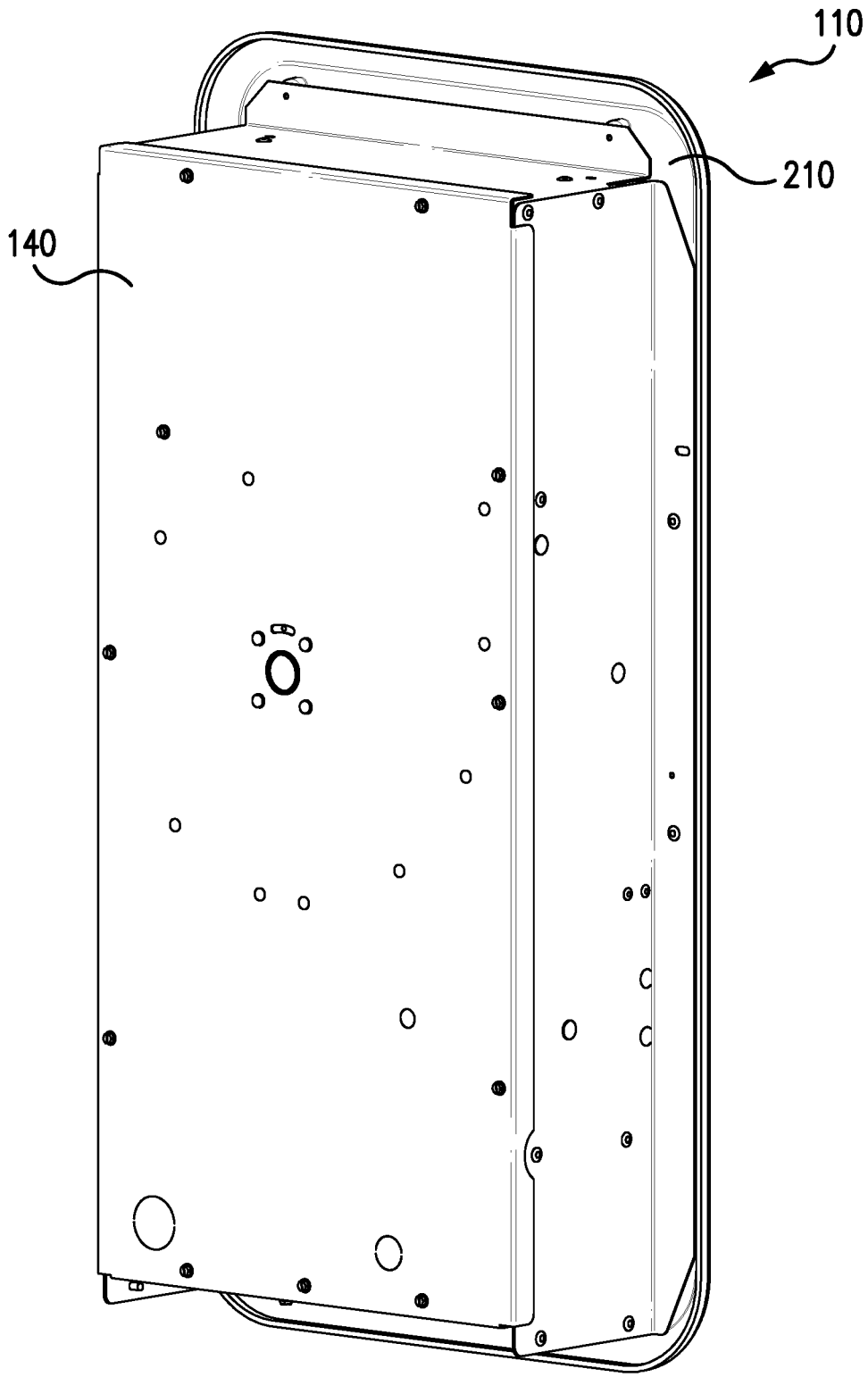
Figure 3:
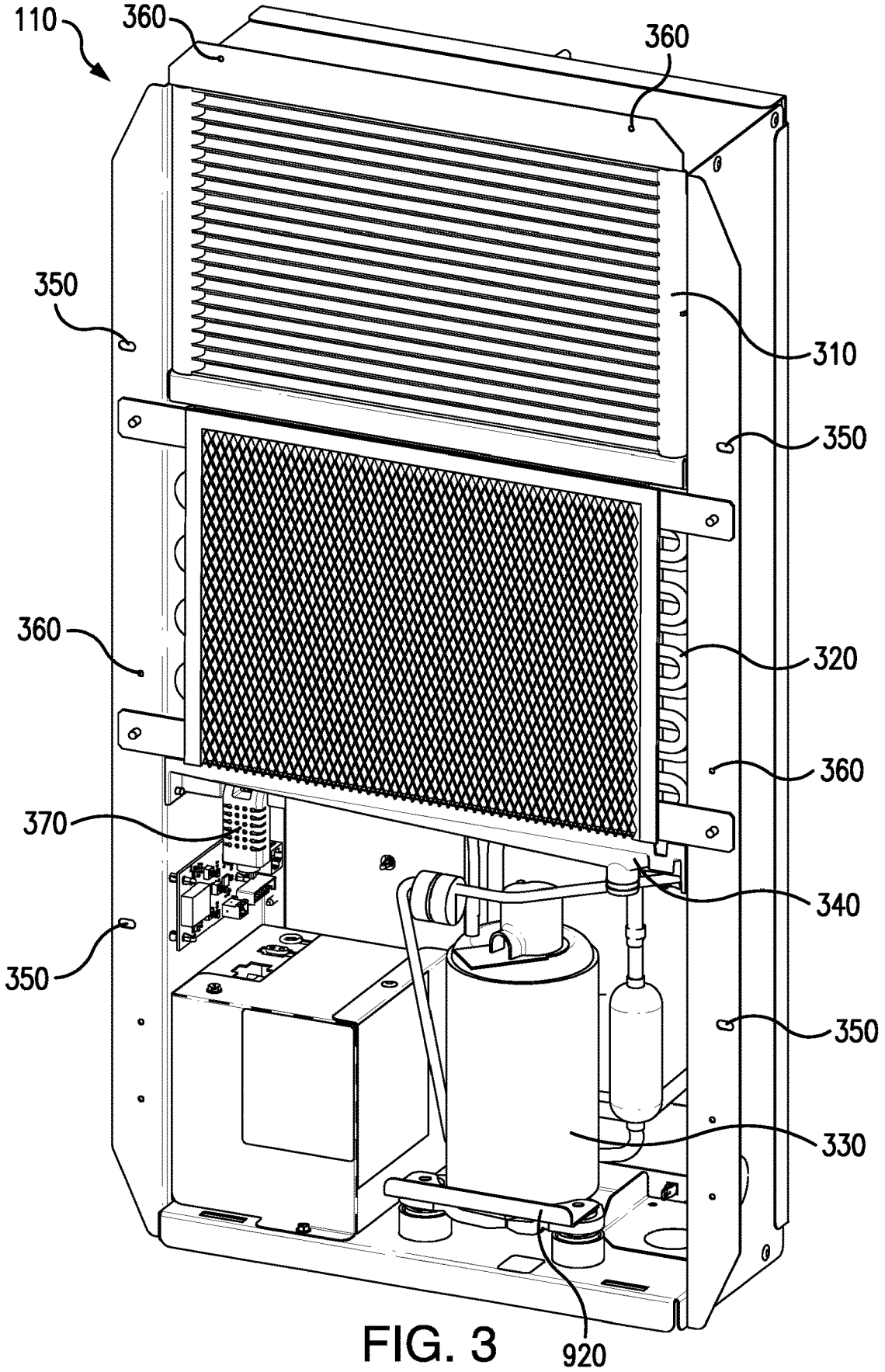
FIG. 3 illustrates an arrangement of internal components of the in-wall dehumidifier of FIG. 1, according to certain embodiments.
Figure 4:
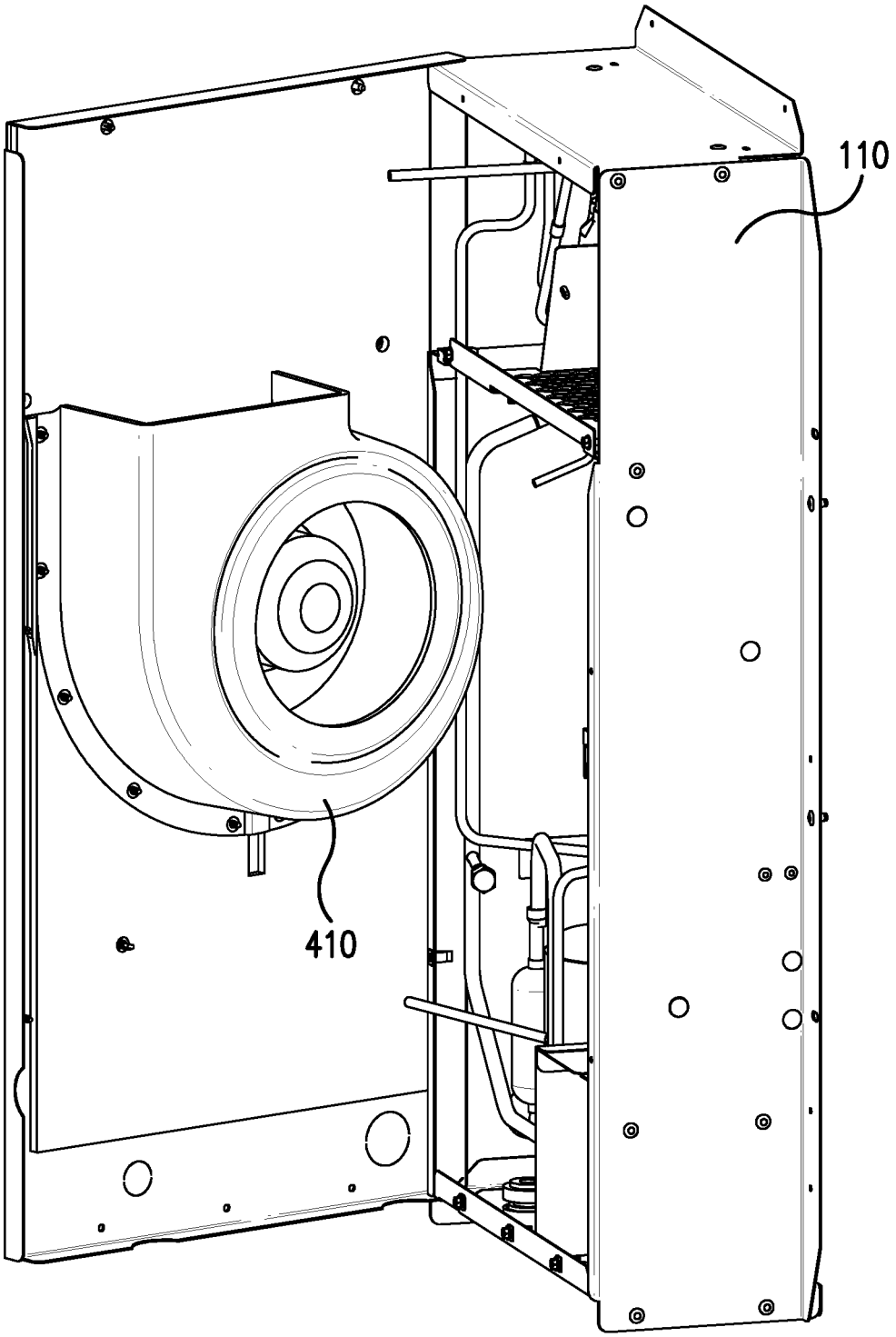
FIG. 4 illustrates the in-wall dehumidifier of FIG. 1 with its rear panel opened, according to certain embodiments.
Figure 5A:
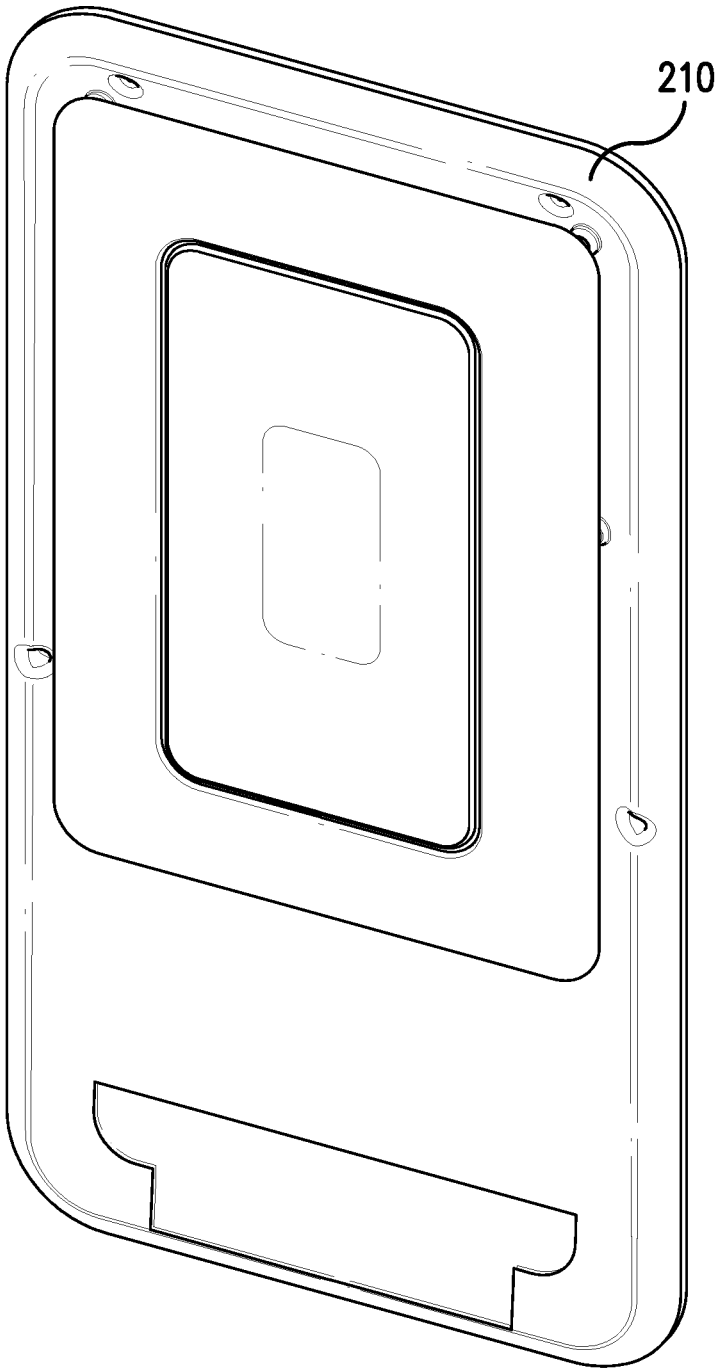
FIGS. 5A-5B illustrate perspective views of the air diffuser of the in-wall dehumidifier of FIG. 1, according to certain embodiments.
Figure 5B:
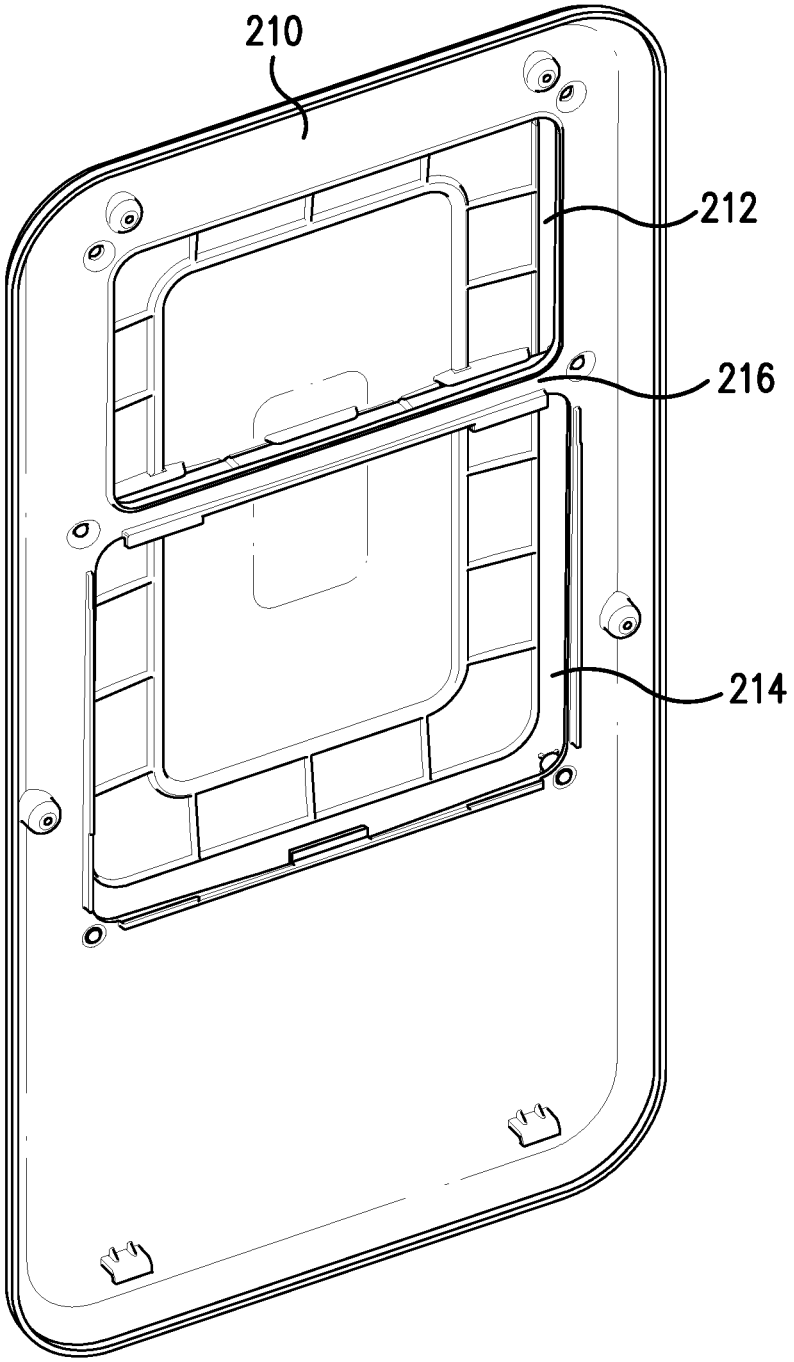
Figure 6A:
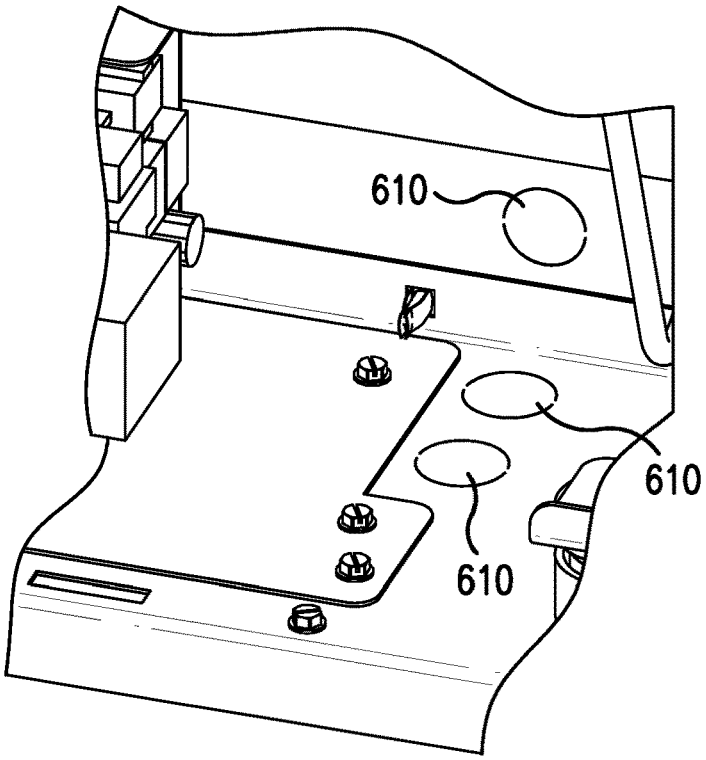
FIGS. 6A-6B illustrate various electrical and plumbing knockouts of the in-wall dehumidifier of FIG. 1, according to certain embodiments.
Figure 6B:
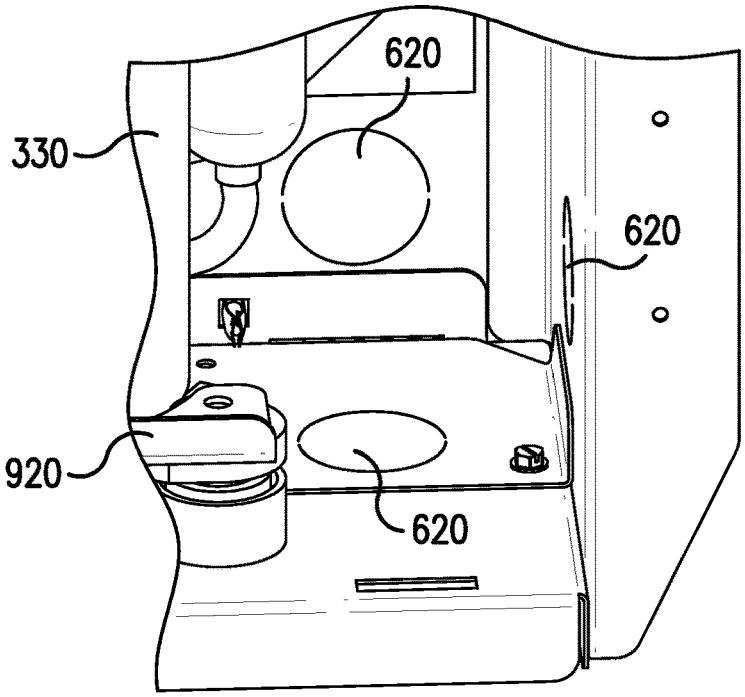
Figure 7A:
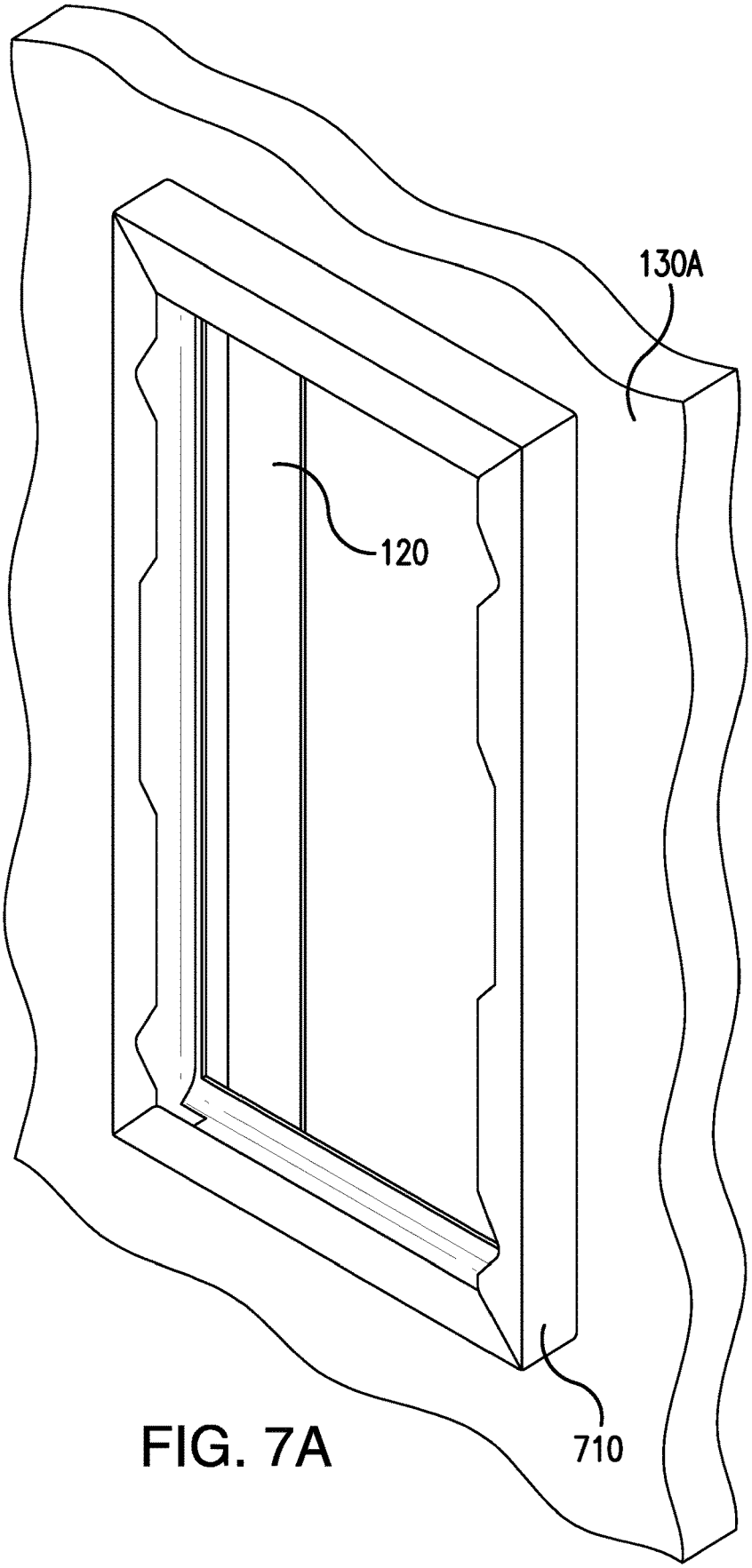
FIGS. 7A-7B illustrate various views of an optional bezel of the in-wall dehumidifier of FIG. 1, according to certain embodiments.
Figure 7B:
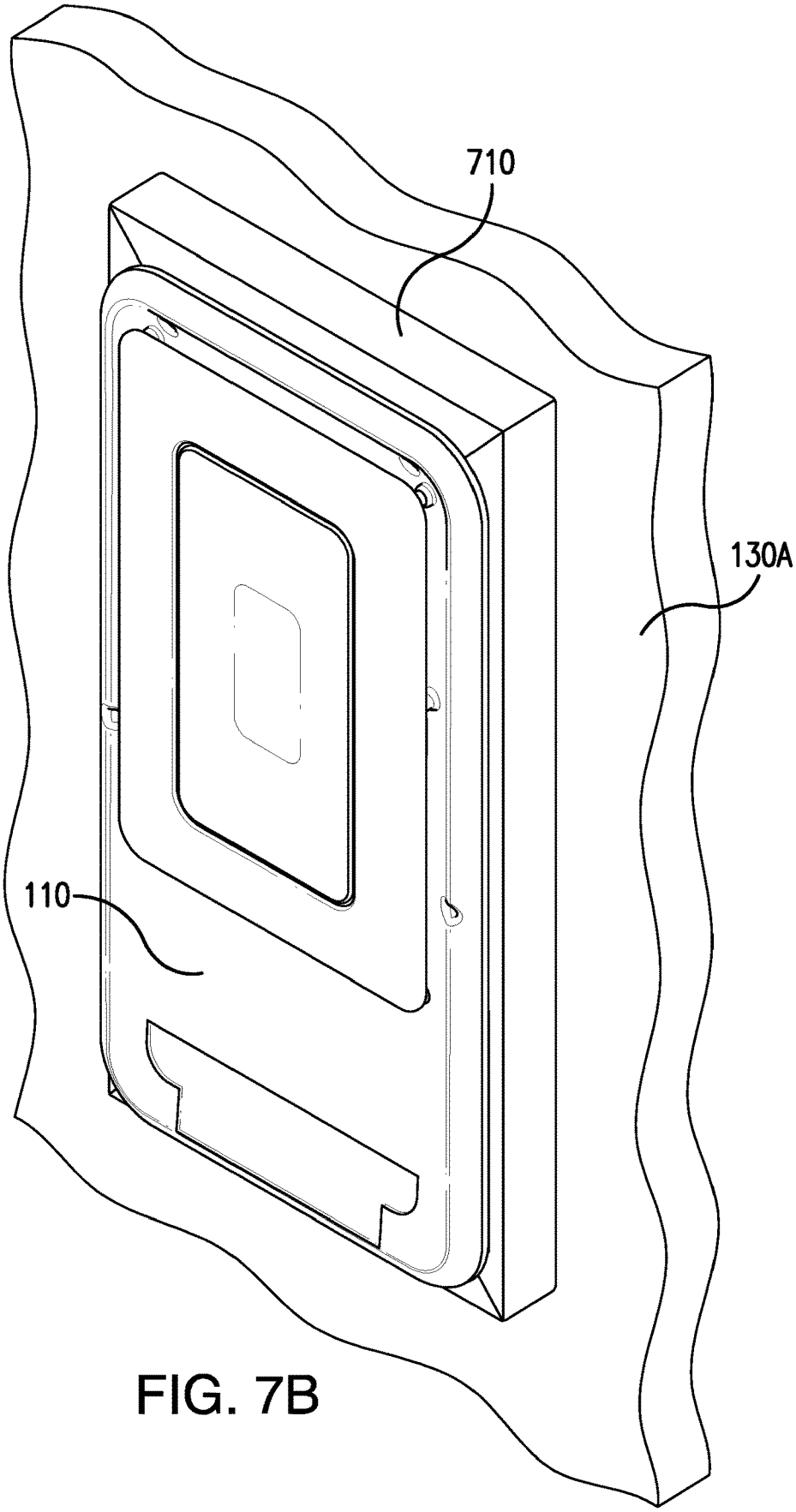
Figure 8A:
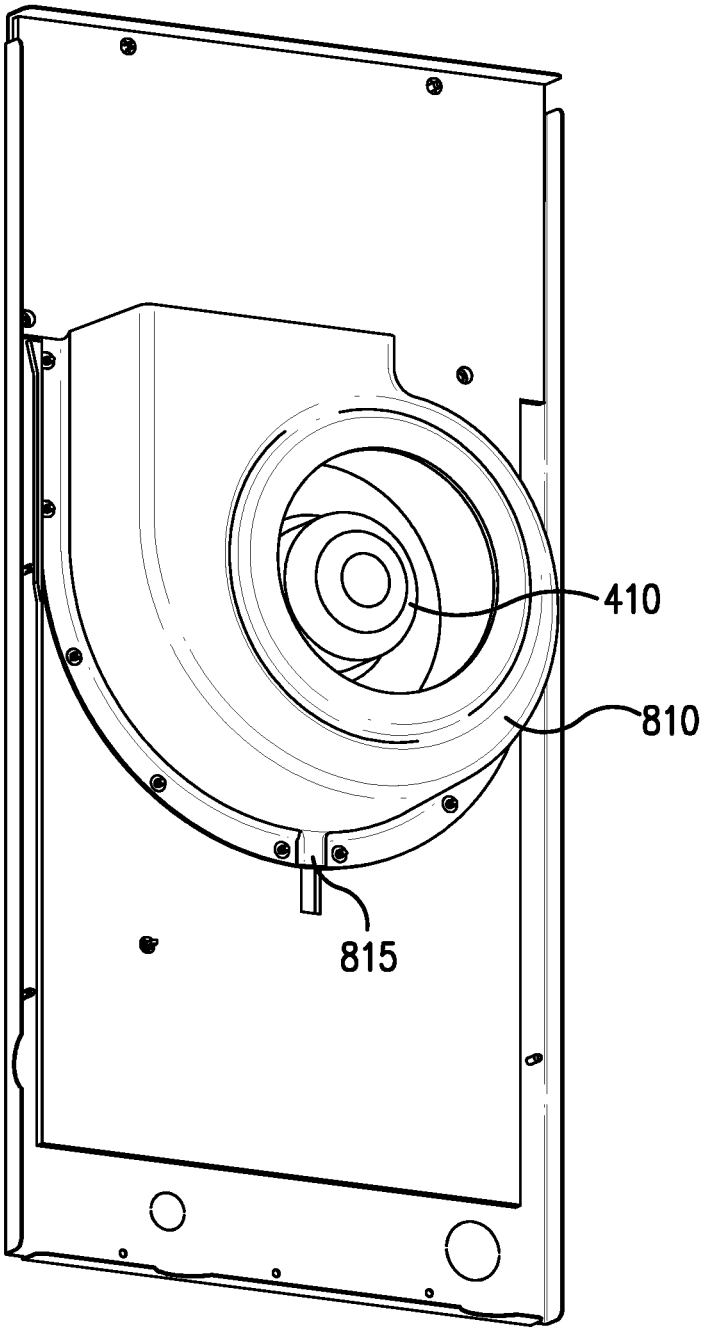
FIGS. 8A-8B illustrate various views of the air blower of the in-wall dehumidifier of FIG. 1, according to certain embodiments.
Figure 8B:
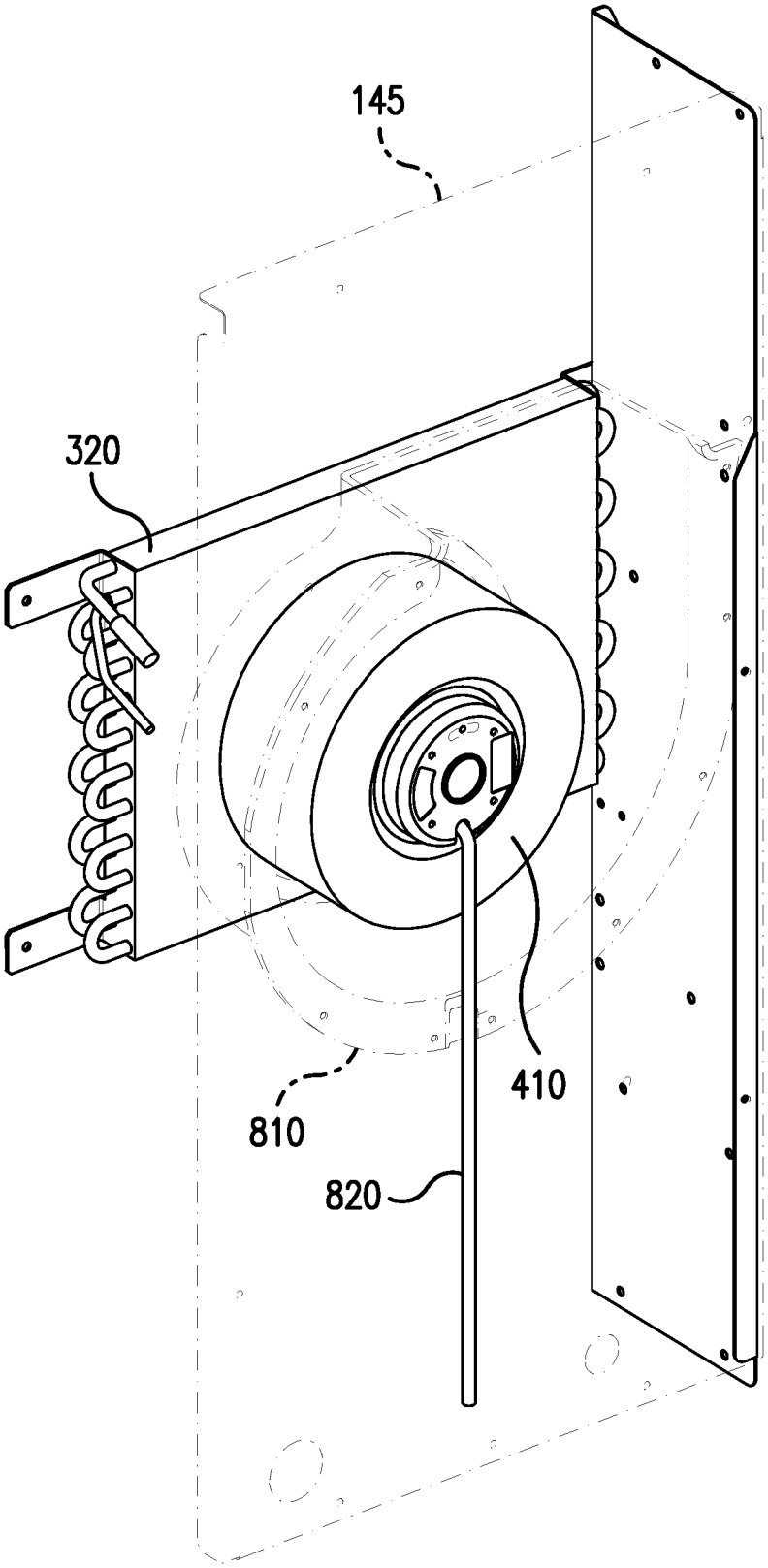
Figure 9:
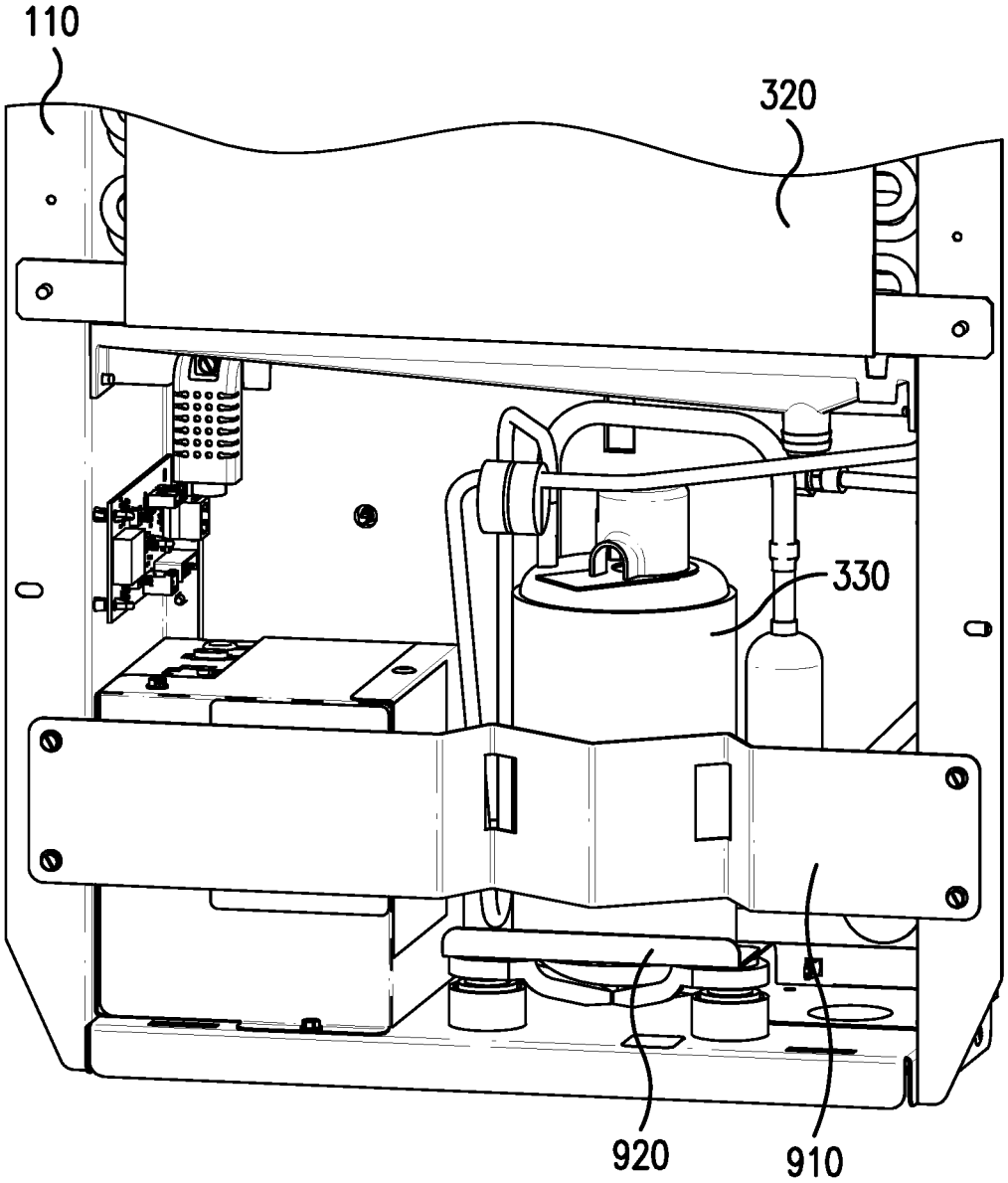
FIG. 9 illustrates various brackets of the in-wall dehumidifier of FIG. 1, according to certain embodiments.
Figure 10:
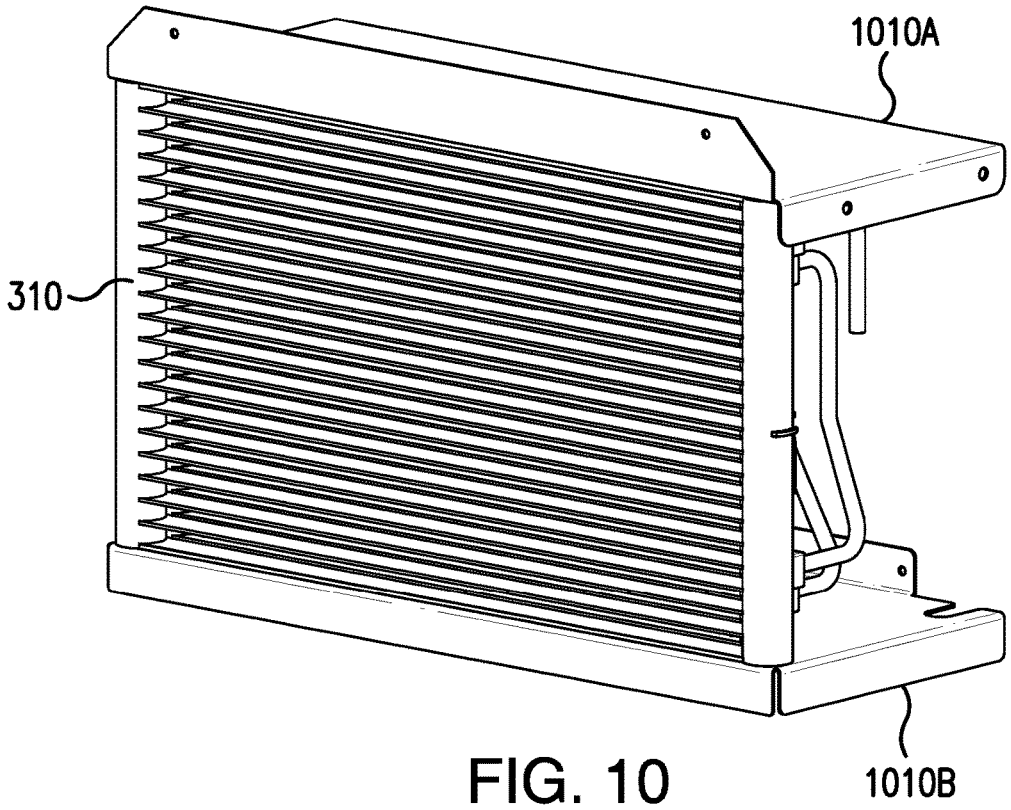
FIG. 10 illustrates condenser brackets of the in-wall dehumidifier of FIG. 1, according to certain embodiments.
Figure 11:
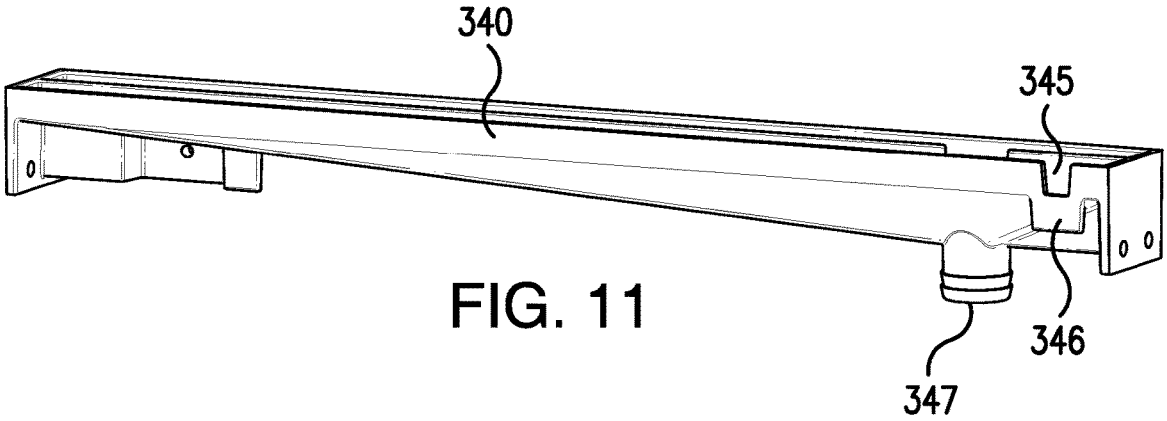
FIG. 11 illustrates a drain pan of the in-wall dehumidifier of FIG. 1, according to certain embodiments.
Figure 12:
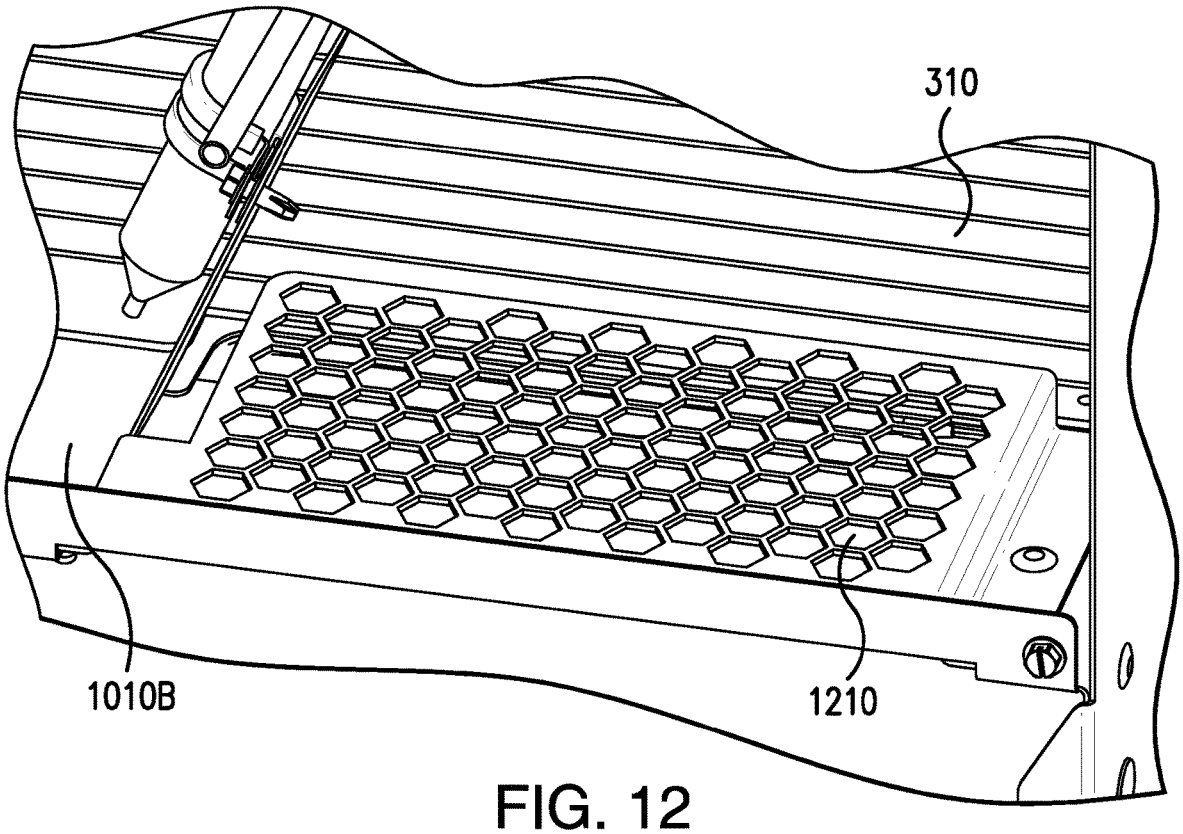
FIG. 12 illustrates a fan outlet diffuser of the in-wall dehumidifier of FIG. 1, according to certain embodiments.
Figure 13:
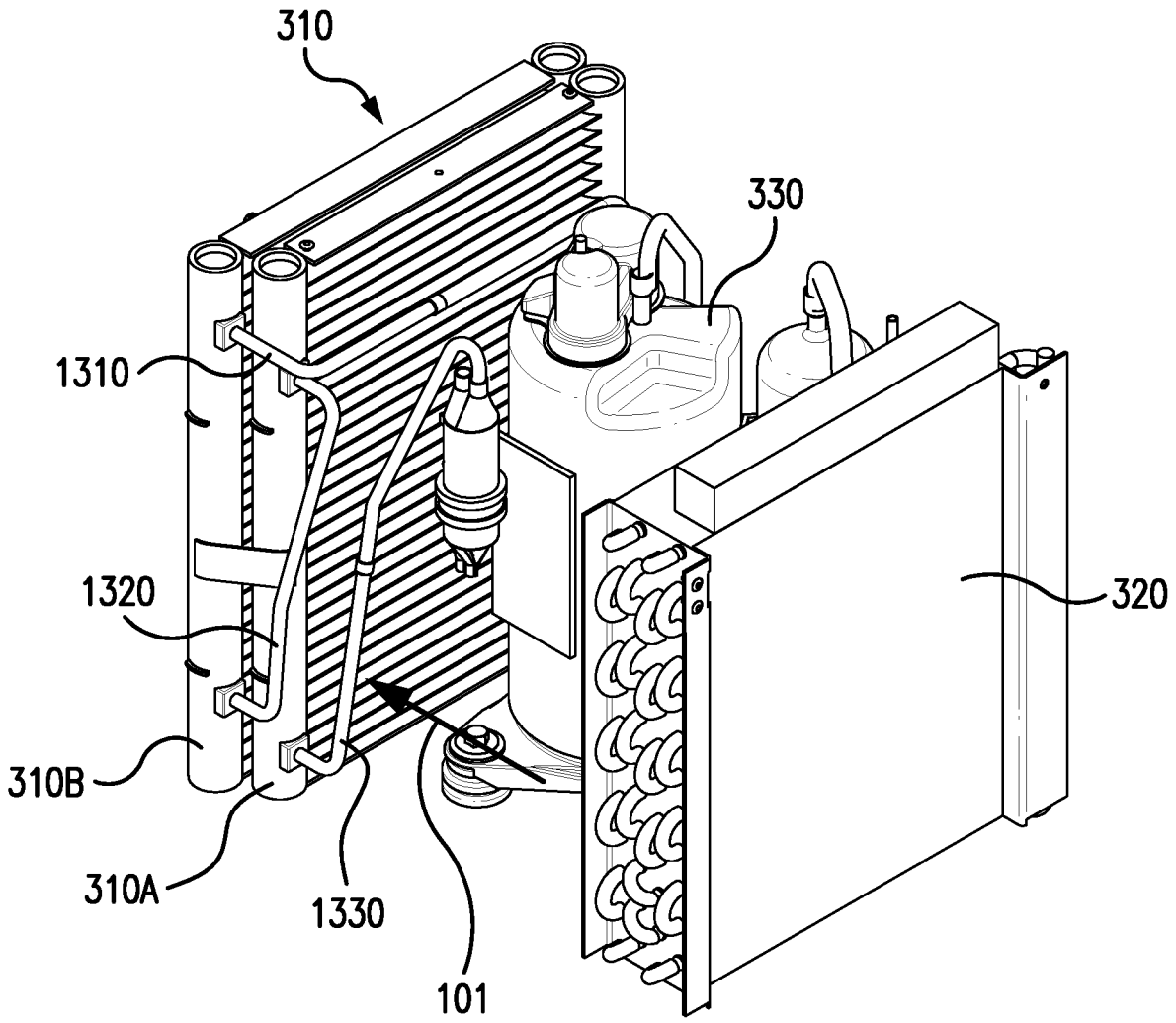
FIG. 13 illustrates a condenser with dual condenser coils that may be used by the in-wall dehumidifier of FIG. 1, according to certain embodiments.
Figure 14:
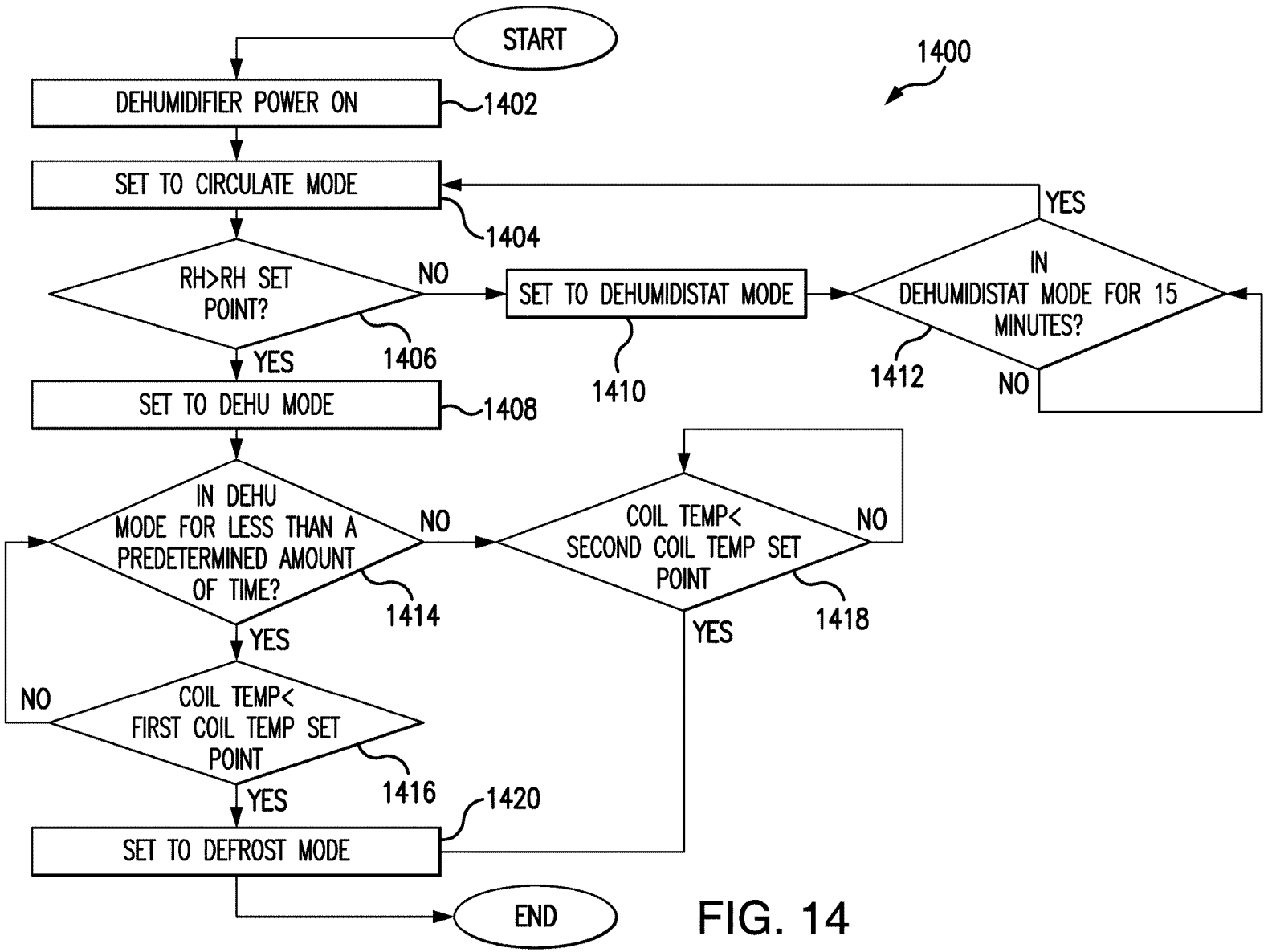
FIG. 14 illustrates a method of controlling the in-wall dehumidifier of FIG. 1, according to certain embodiments.
Figure 15:
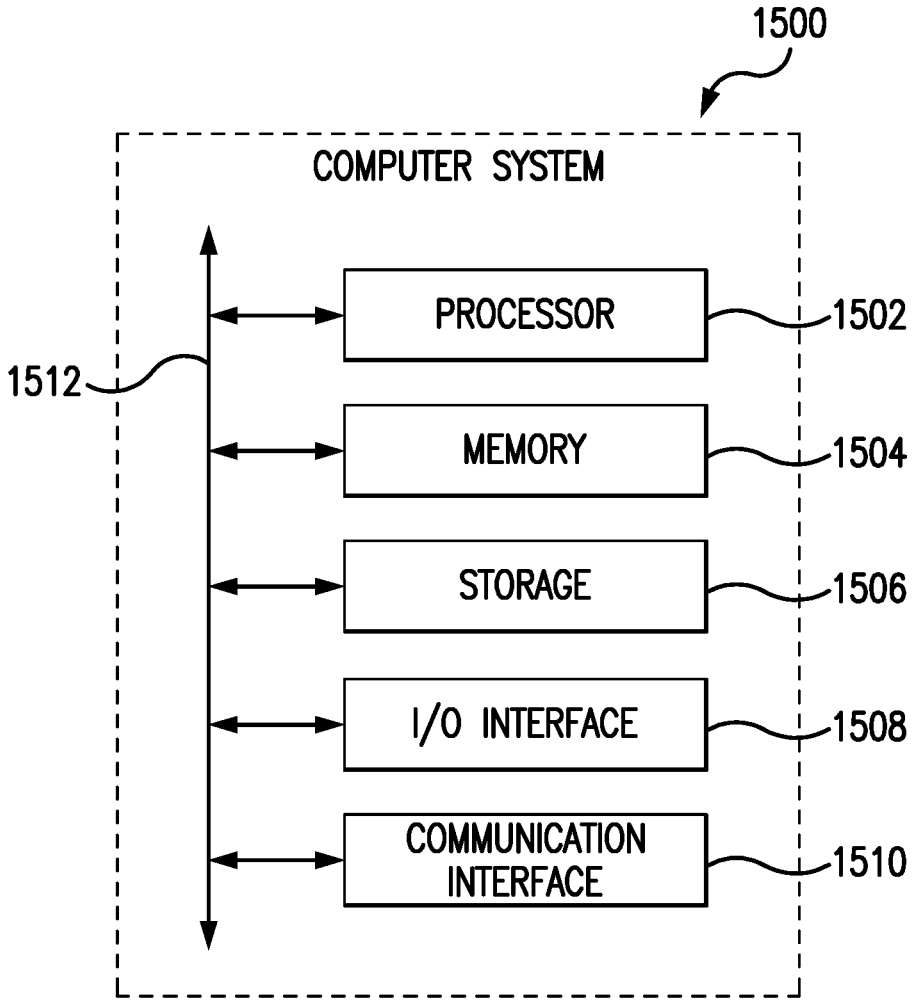
FIG. 15 illustrates an example computer system, according to certain embodiments.

The disclosed embodiments provide an in-wall dehumidifier that includes various features to address the inefficiencies and other issues with current dehumidification systems. The advantages and features of certain embodiments are discussed in more detail below in reference to FIGS. 1-13. FIG. 1 illustrates certain embodiments of an in-wall dehumidifier that may be installed between typical wall studs; FIGS. 2A-2B illustrate perspective views of an in-wall dehumidifier; FIG. 3 illustrates an arrangement of internal components of an in-wall dehumidifier; FIG. 4 illustrates an in-wall dehumidifier with its rear panel opened; FIGS. 5A-5B illustrate perspective views of an air diffuser of an in-wall dehumidifier; FIGS. 6A-6B illustrate various electrical and plumbing knockouts of an in-wall dehumidifier; FIGS. 7A-7B illustrate various views of an optional bezel of an in-wall dehumidifier; FIGS. 8A-8B illustrate various views of an air blower of an in-wall dehumidifier; FIG. 9 illustrates various brackets of an in-wall dehumidifier; FIG. 10 illustrates condenser brackets of an in-wall dehumidifier; FIG. 11 illustrates a drain pan of an in-wall dehumidifier; FIG. 12 illustrates a fan outlet diffuser of an in-wall dehumidifier; FIG. 13 illustrates a condenser with dual condenser coils that may be used by an in-wall dehumidifier; FIG. 14 illustrates a method of controlling an in-wall dehumidifier; and FIG. 15 illustrates an example computer system.

FIGS. 1-4 illustrate various views of an in-wall dehumidifier 110, according to certain embodiments. In some embodiments, in-wall dehumidifier 110 includes a cabinet 140, an air diffuser 210, a condenser 310, an evaporator 320, a compressor 330, a drain pan 340, and a sensor 370. While a specific arrangement of these and other components of in-wall dehumidifier 110 are illustrated in these figures, other embodiments may have other arrangements and may have more or fewer components than those illustrated.

In general, in-wall dehumidifier 110 provides dehumidification to an area (e.g., the living areas of a home or apartment) by moving air through in-wall dehumidifier 110. To dehumidify air, in-wall dehumidifier 110 generates an airflow 101 that enters cabinet 140 via air diffuser 210, travels through in-wall dehumidifier 110 where it is dried, and then exits cabinet 140 via air diffuser 210. Water removed from airflow 101 via in-wall dehumidifier 110 may be captured within drain pan 340 and directed to an external drain. A particular embodiment of drain pan 340 is described in more detail below in reference to FIG. 11.

As illustrated in FIG. 1, in-wall dehumidifier 110 may be installed between wall studs 120 of any wall of a structure such as a home or apartment. In-wall dehumidifier 110 may have any appropriate sizes and shapes that permit it to be installed between typical or standard spacing of wall studs 120 (e.g., 16 or 24 inches apart). Unlike existing dehumidification systems, some embodiments of in-wall dehumidifier 110 may be able to be blindly installed within walls (i.e., installed while only requiring access from one side of a wall). For example, some embodiments of in-wall dehumidifier 110 have a limited depth that allows an installer to remove a portion of drywall 130A from only one side of a wall and install in-wall dehumidifier 110 between wall studs 120 without having to remove any drywall 130B from the other side of the wall. This provides for an easier installation over existing units, which saves installation time and costs. Furthermore, some embodiments of in-wall dehumidifier 110 include air diffuser 210, which is discussed in more detail below in reference to FIGS. 5A-5B. As illustrated in FIG. 1, air diffuser 210 forces output airflow 101 along the surfaces of the wall in which in-wall dehumidifier 110 is installed (i.e., parallel to the wall surfaces). This is in contrast to typical systems which send dehumidified air back into the living space perpendicular to the wall, thereby causing undesirable drafts in the living spaces. By utilizing air diffuser 210 to diffuse airflow 101 along the wall surfaces, in-wall dehumidifier 110 reduces or eliminates undesirable drafts in the living spaces.

Cabinet 140 may be any appropriate shape and size. In some embodiments, cabinet 140 has a width that permits in-wall dehumidifier 110 to be installed between wall studs 120. For example, some embodiments of cabinet 140 have a width that permits in-wall dehumidifier 110 to be installed between wall studs 120 that are 16 or 24 inches apart. In some embodiments, cabinet 140 has a depth that permits in-wall dehumidifier 110 to be blindly installed into a wall without having to remove any portion of drywall 130B from the back side of the wall. For example, cabinet 140 may have a depth that allows it to be installed in walls that utilize typical 2×4 or 2×6 wall studs 120 without removing any portion of drywall 130B.

In-wall dehumidifier 110 includes fan 410 that, when activated, draws airflow 101 into in-wall dehumidifier 110 via air diffuser 210. Fan 410 causes airflow 101 to flow through evaporator 320 and into condenser 310, and exhausts airflow 101 out of in-wall dehumidifier 110 via air diffuser 210. In some embodiments, fan 410 is located within cabinet 140 behind evaporator 320 as illustrated in FIG. 4. In such embodiments, fan 410 is installed between evaporator 320 and a back surface of cabinet 140 (i.e., the side of cabinet 140 that is opposite air diffuser 210). Fan 410 may be any type of air mover (e.g., axial fan, forward inclined impeller, backward inclined impeller, etc.) that is configured to generate airflow 101 that flows through in-wall dehumidifier 110 for dehumidification and exits in-wall dehumidifier 110 through air diffuser 210.

In-wall dehumidifier 110 includes various components to provide dehumidification to airflow 101. In-wall dehumidifier 110 may include condenser 310, evaporator 320, and compressor 330. Particular embodiments of condenser 310 are described in more detail below with respect to FIG. 13. These and other internal components of in-wall dehumidifier 110 are uniquely arranged so as to minimize the size of in-wall dehumidifier 110 and allow it to fit between wall studs 120 in a wall, to provide quiet and efficient dehumidification, and to minimize or eliminate unwanted drafts. As discussed above, fan 410 may be located within cabinet 140 behind evaporator 320 as illustrated in FIG. 4. In some embodiments, condenser 310 may be located in a top compartment of in-wall dehumidifier 110, evaporator 320 may be installed in a center compartment of in-wall dehumidifier 110, and compressor 330 may be located in a bottom compartment of in-wall dehumidifier 110 as illustrated in FIG. 3. In other embodiments, any other appropriate arrangement of these and other components of in-wall dehumidifier 110 may be used.

In some embodiments, evaporator 320 is physically isolated from cabinet 140 around the edges/sides of evaporator 320. In other words, evaporator 320 may include gaps on some or all sides of evaporator 320 that allow for bypass air (i.e., air that does not enter evaporator 320) to move between evaporator 320 and cabinet 140. This helps to keep conduction to cabinet 140 to a minimum, thereby reducing or eliminating cold spots on cabinet 140 which may cause condensation.

In some embodiments, in-wall dehumidifier 110 includes various unit mounting holes 350 for mounting in-wall dehumidifier 110 to wall studs 120, and air diffuser mounting holes 360 for mounting air diffuser 210 to in-wall dehumidifier 110. In some embodiments, unit mounting holes 350 and air diffuser mounting holes 360 have different shapes as illustrated in FIG. 3 to aid in the installation of in-wall dehumidifier 110. For example, unit mounting holes 350 may have an oblong shape and air diffuser mounting holes 360 may be round in some embodiments. This may help the installer to distinguish the purpose for each of the holes. Furthermore, by having an oblong shape, unit mounting holes 350 may enable the installer to adjust the position of in-wall dehumidifier 110 so that the sides of cabinet 140 are not in contact with wall studs 120. This may help to lower the amount of noise and vibration caused by in-wall dehumidifier 110 when it is in operation.

In some embodiments, in-wall dehumidifier 110 may include one or more sensors 370 for sensing temperature, humidity, and other environmental conditions needed for proper operation of in-wall dehumidifier 110. In some embodiments, as illustrated in FIG. 3, sensor 370 may be installed below drain pan 340 and proximate to evaporator 320 so that it may sense airflow 101 before it enters evaporator 320. In this position, sensor 370 is located away from the coils of evaporator 320 in a low, constant bypass airflow, thereby providing for more accurate ambient measurements. In some embodiments, bypass air (i.e., a portion of the airflow that does not enter evaporator 320) is present under drain pan 340 and evaporator 320. The bypass air flows over sensor 370 to give an accurate reading of the conditioned space. This helps to keep drain pan 340 dry and allows for the air volume over condenser 310 to be different (i.e., greater) than the airflow over evaporator 320 while still only using one fan 410. This improves moisture removal efficiency. Sensor 370 may be any appropriate sensor such as a thermometer, humidistat, pressure sensor, and the like.

FIGS. 5A-5B illustrate perspective views of air diffuser 210, according to certain embodiments. As explained above, air diffuser 210 generally forces output airflow 101 along the surfaces of the wall in which in-wall dehumidifier 110 is installed (i.e., parallel to the wall surfaces). This is in contrast to typical systems which send dehumidified air back into the living space perpendicular to the wall, thereby causing undesirable drafts in the living spaces. In some embodiments, air diffuser 210 includes an outlet 212, an inlet 214, and a divider 216. Airflow 101 may enter in-wall dehumidifier 110 through inlet 214 and may exit in-wall dehumidifier 110 through outlet 212. Divider 216 is generally configured to prevent airflow 101 entering cabinet 140 through inlet 214 from mixing with airflow 101 exiting cabinet 140 from outlet 212. In some embodiments, divider 216 contacts a foam strip (or any other material) located on the front of cabinet 140 between condenser 310 and evaporator 320 in order to further restrict the mixing of airflow 101.

FIGS. 6A-6B illustrate various electrical and plumbing knockouts of in-wall dehumidifier 110, according to certain embodiments. FIG. 6A illustrates various electrical knockouts 610 that may be included in cabinet 140 that permit electrical cables to enter/exit cabinet 140. In some embodiments, one or more electrical knockouts 610 may be included in any appropriate location within cabinet 140 (e.g., the bottom, sides, or back). In some embodiments, multiple electrical knockouts 610 are included to accommodate installations with varying wall depths. FIG. 6B illustrates various drain hose knockouts 620 that may be included in cabinet 140 that permit a drain hose to enter/exit cabinet 140. Similar to electrical knockouts 610, one or more drain hose knockouts 620 may be included in any appropriate location within cabinet 140 (e.g., the bottom, sides, or back).

FIGS. 7A-7B illustrate various views of an optional bezel 710 that may be used with in-wall dehumidifier 110, according to certain embodiments. In some embodiments, in-wall dehumidifier 110 may be sized to be blindly installed within walls that utilize 2×6 wall studs 120 and be flush with the surface of the wall. Such embodiments may also be blindly installed in walls with 2×4 wall studs 120, but will not be flush with the wall. If such embodiments are blindly installed in walls with 2×4 wall studs 120, bezel 710 may be added to enhance the appearance of in-wall dehumidifier 110 and provide for a more professional-looking installation.

FIGS. 8A-8B illustrate various views of fan 410, according to certain embodiments. In some embodiments, fan 410 is located between evaporator 320 and a back panel 145 of cabinet 140 as illustrated in FIG. 8B. In some embodiments, fan 410 includes a blower scroll 810 that is coupled to back panel 145. In some embodiments, blower scroll 810 includes a molded clamp 815 that securely fastens a rigid wiring conduit 820 against back panel 145, as illustrated. Molded clamp 815 and rigid wiring conduit 820 helps protect wires within rigid wiring conduit 820 from being damaged by rotating components of fan 410 (e.g., a squirrel cage) while still maintaining the overall depth of cabinet 140.

FIG. 9 illustrates various brackets of in-wall dehumidifier 110, according to certain embodiments. In some embodiments, a shipping bracket 910 may be included as illustrated in order to secure compressor 330 during shipment. Shipping bracket 910 may be removed during installation of in-wall dehumidifier 110. In some embodiments, in-wall dehumidifier 110 may include a compressor mounting bracket 920 as illustrated. In general, compressor mounting bracket 920 may be installed in place of standard washers used to secure compressor 330 to cabinet 140. Compressor mounting bracket 920 may provide a more secure attachment for compressor 330 during shipping and rough handling of in-wall dehumidifier 110. Furthermore, by being secured at two locations, compressor mounting bracket 920 may be prevented from touching compressor 330, thereby mitigating sound and vibration caused by compressor 330 when in operation.

FIG. 10 illustrates condenser brackets 1010A-B that may be used to attach condenser 310 to in-wall dehumidifier 110, according to certain embodiments. In some embodiments, condenser 310 may be used to hard mount condenser 310 to cabinet 140 in order to conduct heat out of condenser 310 and into cabinet 140 where it may help reduce or eliminate condensation on in-wall dehumidifier 110.

FIG. 11 illustrates an example drain pan 340 of in-wall dehumidifier 110, according to certain embodiments. In general, drain pan 340 collects water that is removed from airflow 101 by in-wall dehumidifier 110. In some embodiments, drain pan 340 includes a drain 347. Any appropriate hose may be coupled to drain 347 in order to direct water out of in-wall dehumidifier 110. In some embodiments, drain pan 340 is sloped as illustrated in order to direct water to drain 347. In some embodiments, drain pan 340 includes a notch 345 and a tab 346 that are configured to direct an overflow from drain pan 340 to a front face of cabinet 140, thereby causing the overflow to be visible when in-wall dehumidifier 110 is installed in the wall. As illustrated, notch 345 may be at a top, front corner of drain pan 340 and may only extend down a certain portion of the height of drain pan 340 in order to direct any overflow to the front of cabinet 140. In some embodiments, tab 346 is directly below notch 345 as illustrated.

FIG. 12 illustrates a fan outlet diffuser 1210 of in-wall dehumidifier 110, according to certain embodiments. In general, fan outlet diffuser 1210 includes a number of apertures that are configured to evenly distribute airflow 101 as it leaves fan 410 and enters condenser 310. This helps to reduce any noise caused by airflow 101. In some embodiments, fan outlet diffuser 1210 is coupled to condenser bracket 1010B as illustrated, which is between the outlet of fan 410 and condenser 310. The apertures of fan outlet diffuser 1210 may have any appropriate shape including, but not limited to, circular, polygonal (e.g., square, hexagonal, etc.), and the like. Any appropriate number and size of apertures may be included in fan outlet diffuser 1210.

FIG. 13 illustrates an embodiment of condenser 310 that includes dual condenser coils 310A-B that may be used by in-wall dehumidifier 110, according to certain embodiments. The arrangement of components in FIG. 13 are for illustrative purposes only. In some embodiments, condenser 310, evaporator 320, and compressor 330 may be arranged as illustrated in FIG. 3 (i.e., condenser 310 at the top of cabinet 140, evaporator 320 below condenser 310, and compressor 330 below evaporator 320). In some embodiments, second condenser coil 310B is connected to compressor 330 via a superheated vapor line 1310. First condenser coil 310A is connected to evaporator 320 via a subcooled liquid line 1330. In some embodiments, an expansion valve is included on subcooled liquid line 1330 between first condenser coil 310A and evaporator 320. First condenser coil 310A and second condenser coil 310B are connected via a condenser connection line 1320. Condenser connection line 1320 connects an output of second condenser coil 310B with an input of first condenser coil 310A. In other words, condenser coils 310 are connected in series, which provides many advantages as discussed in more detail below.

In some embodiments, condenser coils 310A-B are microchannel condensers that are made of aluminum. In general, microchannel condensers provide numerous features including a high heat transfer coefficient, a low air-side pressure restriction, and a compact design (compared to other solutions such as finned tub exchangers). These and other features make microchannel condensers good options for condensers in air conditioning systems where inlet air temperatures are high and airflow is high with low fan power. However, in a dehumidifier, the primary air side pressure drop occurs in the evaporator, and reducing condenser air restriction does not increase airflow significantly. Also, the air temperature upstream of the condenser is typically relatively low, often being below 60° F. The air temperature leaving the condenser is typically over 100° F. The air temperature across the condenser typically increases over 40° F. Using this low temperature air stream efficiently is the key to a good design. In dehumidifier designs, the refrigeration system typically needs to have at least 20° F. subcooling when a finned tube condenser is used. Since a normal microchannel condenser does not provide cross counter flow, it is very difficult to get 20° F. subcooling. The weakness of micro-channel condenser (e.g., no cross counter flow) becomes significant when air temperature rises over 40° F. across the condenser. Due to this, a typical microchannel condenser is not a good condenser for a dehumidifier. To overcome these and other issues, some embodiments of in-wall dehumidifier 110 include two condenser coils 310A-G connected in series as described herein. In this configuration, the pressure drop of two microchannel condenser coils 310A-B is still lower than that of a single finned tube coil. In addition, since a microchannel coil is thinner than a multi-row finned tube coil, the thickness of two microchannel condenser coils 310A-B is less than an equivalent single finned tube coil. By using two or more microchannel condenser coils 310A-B in series to make a cross counter flow condenser, more than 20° F. of subcooling may be achieved with a reasonable approach temperature when inlet air temperature is below 60° F. Furthermore, aluminum is typically less costly than copper, so the cost of a dual microchannel aluminum condenser is less than a single finned copper tube condenser.

In operation, refrigerant flows from evaporator 320 into compressor 330, from compressor 330 into second condenser coil 310B via superheated vapor line 1310, from second condenser coil 310B into first condenser coil 310A via condenser connection line 1320, from first condenser coil 310A back to evaporator 320 (through an expansion valve in some embodiments) via subcooled liquid line 1330. The unique configuration of condenser 310 allows the refrigerant to be managed based on the direction of airflow 101 and temperature. That is, the coldest air (i.e., airflow 101 when it first hits first condenser coil 310A) subcools the liquid refrigerant within first condenser coil 310A, and the hottest air (i.e., airflow 101 when it first hits second condenser coil 310B after leaving first condenser coil 310A) de-superheats the vapor refrigerant as it passes through second condenser coil 310B.

While a particular embodiment of condenser 310 has been described as having two condenser coils 310A-B, other embodiments may have more than two condenser coils 310. For example, other embodiments of dehumidification system 1300 may have three or four condenser coils 310. In such embodiments, condenser coils 310 are connected in series using multiple condenser connection lines 1320 as described above.

Although a particular implementation of in-wall dehumidifier 110 is illustrated and primarily described, the present disclosure contemplates any suitable implementation of in-wall dehumidifier 110, according to particular needs. Moreover, although various components of in-wall dehumidifier 110 have been depicted as being located at particular positions, the present disclosure contemplates those components being positioned at any suitable location, according to particular needs.

FIG. 14 illustrates a method 1400 of controlling in-wall dehumidifier 110, according to certain embodiments. In general, method 1400 may be utilized by in-wall dehumidifier 110 to set the in-wall dehumidifier 110 to different operating modes. Method 1400 may begin in step 1402 where in-wall dehumidifier 110 is powered on. In some embodiments, in-wall dehumidifier 110 may be initially at a power off state when fan 410 and compressor 330 are both turned off. A user may power on the in-wall dehumidifier 110 by pressing a power button of the in-wall dehumidifier 110. In some embodiments, after powering on in-wall dehumidifier 110, a user may use a control panel of in-wall dehumidifier 110 to set a relative-humidity (RH) set point. In some embodiments, the relative-humidity set point is accessed or otherwise retrieved from memory (e.g., within in-wall dehumidifier 110). An example relative-humidity set point may be anywhere between 35 and 50%. In some embodiments, a first evaporator coil temperature set point and a second evaporator coil temperature set point may be stored within in-wall dehumidifier 110. In some embodiments, the first evaporator coil temperature set point and the second evaporator coil temperature set point is accessed or otherwise retrieved from memory (e.g., within in-wall dehumidifier 110). In some embodiments, the first evaporator coil temperature set point is below a dew point. For example, the first evaporator coil temperature set point may be 27° F. In some embodiments, the second evaporator coil temperature set point is higher than the first evaporator coil temperature set point and lower than the dew point. For example, the second evaporator coil temperature set point may be anywhere between 27° F. and 32° F.

At step 1404, in-wall dehumidifier 110 is set to a circulate mode. In some embodiments, in-wall dehumidifier 110 is configured to sample the ambient air when operating in the circulate mode. For example, the in-wall dehumidifier 110 may be configured to determine the humidity of the ambient air. Specifically, when in-wall dehumidifier 110 operates in the circulate mode, fan 410 is enabled and the compressor 330 is disabled. By turning on the fan 410, ambient air 101 is drawn into in-wall dehumidifier 110 so that sensor 370 (e.g., a humidistat) in in-wall dehumidifier 110 may sense the humidity of the ambient air 101. In some embodiments, sensor 370 generates a measured relative humidity for the airflow 101.

At step 1406, in-wall dehumidifier 110 determines whether the measured relative humidity is greater than the relative-humidity set point. As noted above, in some embodiments, the measured relative humidity level of incoming airflow 101 may be retrieved from sensor 370 (e.g., a humidistat) that is located within the in-wall dehumidifier 110. After step 1406, method 1400 may proceed to step 1408 or 1410. If the measured relative humidity is equal to or less than the relative-humidity set point, method 1400 proceeds to step 1410. If the measured relative humidity is greater than the relative-humidity set point, method 1400 proceeds to step 1408.

At step 1410, in-wall dehumidifier 110 is set to a dehumidistat mode if the measured relative humidity is equal to or less than the relative-humidity set point. In some embodiments, in-wall dehumidifier 110 is configured to be placed on standby when operating in the dehumidistat mode. Specifically, when in-wall dehumidifier 110 operates in the dehumidistat mode, fan 410 and compressor 330 are both disabled.

At step 1412, after in-wall dehumidifier 110 is set to the dehumidistat mode, method 1400 periodically determines whether in-wall dehumidifier 110 has been operating in the dehumidistat mode for a predetermined amount of time. For example, method 1400 may determine whether in-wall dehumidifier 110 has been operating in the dehumidistat mode for 15 minutes. If in-wall dehumidifier 110 is determined to have been operating in the dehumidistat mode for at least the predetermined amount of time, in-wall dehumidifier 110 is set back to the circulate mode. For example, in-wall dehumidifier 110 may enable fan 410 while keeping the compressor disabled at the end of the predetermined amount of time as determined in step 1412. In this way, in-wall dehumidifier 110 forces itself to stay in the dehumidistat mode for the predetermined amount of time after determining that the measured relative humidity is equal to or less than the relative-humidity set point. This facilitates protecting fan 410 because turning the fan 410 on and off frequently may damage the electrical components and degrade the performance of fan 410.

At step 1408, in-wall dehumidifier 110 is set to a dehumidifying mode (i.e., "dehu" mode) if the measured relative humidity is greater than the relative-humidity set point. In some embodiments, in-wall dehumidifier 110 is configured to reduce the level of humidity in airflow 101 when operating in the dehumidifying mode. Specifically, when in-wall dehumidifier 110 operates in the dehumidifying mode, fan 410 and compressor 330 are both enabled. For example, if the measured relative humidity is greater than the relative-humidity set point, in-wall dehumidifier 110 may enable both fan 410 and compressor 330. After step 1408, method 1400 proceeds to step 1414. In some embodiments, method 1400 waits for a predetermined amount of time (e.g., fifteen minutes) before proceeding to step 1414 after in-wall dehumidifier 110 is set to dehumidifying mode in step 1408.

At step 1414, method 1400 determines whether in-wall dehumidifier 110 has been operating in the dehumidifying mode for less than a predetermined amount of time. For example, method 1400 may determine whether in-wall dehumidifier 110 has been operating in the dehumidifying mode for less than 60 minutes. After step 1414, method 1400 may proceed to step 1416 or step 1418. If in-wall dehumidifier 110 has been operating in the dehumidifying mode for less than the predetermined amount of time, method 1400 proceeds to step 1416. If in-wall dehumidifier 110 has been operating in the dehumidifying mode for equal to or greater than the predetermined amount of time, method 1400 proceeds to step 1418.

At step 1416, method 1400 determines whether a measured evaporator coil temperature is less than the first evaporator coil temperature set point if in-wall dehumidifier 110 has been operating in the dehumidifying mode for less than the predetermined amount of time (e.g., 60 minutes). In some embodiments, the measured evaporator coil temperature may be retrieved from sensor 370 (e.g., a thermometer). As noted before, the first evaporator coil temperature set point is below the dew point. For example, the first evaporator coil temperature set point may be 27° F. If the measured evaporator coil temperature is less than the first evaporator coil temperature set point, method 1400 proceeds to step 1420. If the measured evaporator coil temperature is equal to or greater than the first evaporator coil temperature set point, method 1400 proceeds back to step 1414.

At step 1420, in-wall dehumidifier 110 is set to a defrost mode if the measured evaporator coil temperature is less than the first evaporator coil temperature set point. In some embodiments, in-wall dehumidifier 110 is configured to remove ice accumulated in the coils of evaporator 320 when operating in the defrost mode. As noted before, the first evaporator coil temperature set point is lower than the dew point. When the in-wall dehumidifier 110 operates with the evaporator coil temperature below the dew point, ice may start to build around the coils of evaporator 320. The ice building up on the coils of evaporator 320 will in turn degrade the performance of in-wall dehumidifier 110. Therefore, in-wall dehumidifier 110 may be set to the defrost mode to clear any ice that has formed on the coils of evaporator 320. Specifically, when in-wall dehumidifier 110 operates in the defrost mode, fan 410 is enabled and compressor 330 is disabled.

At step 1418, method 1400 periodically determines whether a measured evaporator coil temperature is less than the second evaporator coil temperature set point if the in-wall dehumidifier 110 has been operating in the dehumidifying mode for equal to or greater than the predetermined amount of time (e.g., 60 minutes). In some embodiments, the measured evaporator coil temperature may be retrieved from sensor 370 (e.g., a thermometer). As noted before, the second evaporator coil temperature set point is higher than the first evaporator coil temperature set point and below the dew point. For example, the second evaporator coil temperature set point may be anywhere between 27° F. and 32° F. If the measured evaporator coil temperature is less than the second evaporator coil temperature set point, method 1400 proceeds to step 1420. For example, in-wall dehumidifier 110 is set to the defrost mode if the measured evaporator coil temperature is less than the second evaporator coil temperature set point. After step 1420, method 1400 may end. In this way, method 1400 sets in-wall dehumidifier 110 to defrost mode when in-wall dehumidifier 110 has been operating in the dehumidifying mode for more than a predetermined amount of time at a temperature higher than the first evaporator coil temperature set point but slightly lower than the dew point. Note that when in-wall dehumidifier 110 operates in the dehumidifying mode at a temperature higher than the first evaporator coil temperature set point but lower than the dew point, ice may still form on the coils of evaporator 320 but at a slower rate than when it operates below the first evaporator coil temperature set point. The ice may form on the coils of evaporator 320 over time and degrade the performance of the in-wall dehumidifier 110. By utilizing the first evaporator coil temperature set point and the second evaporator coil temperature set point as described herein, methods 1400 provides a two-tiered defrost scheme to clear any ice that has accumulated on the coils of evaporator 320. The two-tiered defrost scheme has proven more efficient in clearing the ice built upon the coils of the evaporator 320 and thus increases the efficiency of in-wall dehumidifier 110.

Particular embodiments may repeat one or more steps of method 1400, where appropriate. Although this disclosure describes and illustrates particular steps of method 1400 as occurring in a particular order, this disclosure contemplates any suitable steps of method 1400 occurring in any suitable order. Moreover, although this disclosure describes and illustrates an example method for controlling dehumidification system 110 including the particular steps of method 1400, this disclosure contemplates any suitable method for controlling dehumidification system 110 including any suitable steps, which may include all, some, or none of the steps of method 1400, where appropriate. Furthermore, although this disclosure describes and illustrates particular components, devices, or systems carrying out particular steps of method 800, this disclosure contemplates any suitable combination of any suitable components, devices, or systems carrying out any suitable steps of method 1400.

FIG. 15 illustrates an example computer system 1500. In particular embodiments, one or more computer systems 1500 perform one or more steps of one or more methods described or illustrated herein. In particular embodiments, one or more computer systems 1500 provide functionality described or illustrated herein. In particular embodiments, software running on one or more computer systems 1500 performs one or more steps of one or more methods described or illustrated herein or provides functionality described or illustrated herein. Particular embodiments include one or more portions of one or more computer systems 1500. Herein, reference to a computer system may encompass a computing device, and vice versa, where appropriate. Moreover, reference to a computer system may encompass one or more computer systems, where appropriate.

This disclosure contemplates any suitable number of computer systems 1500. This disclosure contemplates computer system 1500 taking any suitable physical form. As example and not by way of limitation, computer system 1500 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, an augmented/virtual reality device, or a combination of two or more of these. Where appropriate, computer system 1500 may include one or more computer systems 1500; be unitary or distributed; span multiple locations; span multiple machines; span multiple data centers; or reside in a cloud, which may include one or more cloud components in one or more networks. Where appropriate, one or more computer systems 900 may perform without substantial spatial or temporal limitation one or more steps of one or more methods described or illustrated herein. As an example and not by way of limitation, one or more computer systems 1500 may perform in real time or in batch mode one or more steps of one or more methods described or illustrated herein. One or more computer systems 1500 may perform at different times or at different locations one or more steps of one or more methods described or illustrated herein, where appropriate.

In particular embodiments, computer system 1500 includes a processor 1502, memory 1504, storage 1506, an input/output (I/O) interface 1508, a communication interface 1510, and a bus 1512. Although this disclosure describes and illustrates a particular computer system having a particular number of particular components in a particular arrangement, this disclosure contemplates any suitable computer system having any suitable number of any suitable components in any suitable arrangement.

In particular embodiments, processor 1502 includes hardware for executing instructions, such as those making up a computer program. Processor 1502 may be any appropriate processing unit, microprocessor, computer, computing system, and the like. As an example and not by way of limitation, to execute instructions, processor 1502 may retrieve (or fetch) the instructions from an internal register, an internal cache, memory 1504, or storage 1506; decode and execute them; and then write one or more results to an internal register, an internal cache, memory 1504, or storage 1506. In particular embodiments, processor 1502 may include one or more internal caches for data, instructions, or addresses. This disclosure contemplates processor 1502 including any suitable number of any suitable internal caches, where appropriate. As an example and not by way of limitation, processor 1502 may include one or more instruction caches, one or more data caches, and one or more translation lookaside buffers (TLBs). Instructions in the instruction caches may be copies of instructions in memory 1504 or storage 1506, and the instruction caches may speed up retrieval of those instructions by processor 1502. Data in the data caches may be copies of data in memory 1504 or storage 1506 for instructions executing at processor 1502 to operate on; the results of previous instructions executed at processor 1502 for access by subsequent instructions executing at processor 1502 or for writing to memory 1504 or storage 1506; or other suitable data. The data caches may speed up read or write operations by processor 1502. The TLBs may speed up virtual-address translation for processor 1502. In particular embodiments, processor 1502 may include one or more internal registers for data, instructions, or addresses. This disclosure contemplates processor 1502 including any suitable number of any suitable internal registers, where appropriate. Where appropriate, processor 1502 may include one or more arithmetic logic units (ALUs); be a multi-core processor; or include one or more processors 1502. Although this disclosure describes and illustrates a particular processor, this disclosure contemplates any suitable processor.

In particular embodiments, memory 1504 includes main memory for storing instructions for processor 1502 to execute or data for processor 1502 to operate on. As an example and not by way of limitation, computer system 1500 may load instructions from storage 1506 or another source (such as, for example, another computer system 1500) to memory 1504. Processor 1502 may then load the instructions from memory 1504 to an internal register or internal cache. To execute the instructions, processor 1502 may retrieve the instructions from the internal register or internal cache and decode them. During or after execution of the instructions, processor 1502 may write one or more results (which may be intermediate or final results) to the internal register or internal cache. Processor 1502 may then write one or more of those results to memory 1504. In particular embodiments, processor 1502 executes only instructions in one or more internal registers or internal caches or in memory 1504 (as opposed to storage 1506 or elsewhere) and operates only on data in one or more internal registers or internal caches or in memory 1504 (as opposed to storage 1506 or elsewhere). One or more memory buses (which may each include an address bus and a data bus) may couple processor 1502 to memory 1504. Bus 1512 may include one or more memory buses, as described below. In particular embodiments, one or more memory management units (MMUs) reside between processor 1502 and memory 1504 and facilitate accesses to memory 1504 requested by processor 1502. In particular embodiments, memory 1504 includes random access memory (RAM). This RAM may be volatile memory, where appropriate. Where appropriate, this RAM may be dynamic RAM (DRAM) or static RAM (SRAM). Moreover, where appropriate, this RAM may be single-ported or multi-ported RAM. This disclosure contemplates any suitable RAM. Memory 1504 may include one or more memories 1504, where appropriate. Although this disclosure describes and illustrates particular memory, this disclosure contemplates any suitable memory.

In particular embodiments, storage 1506 includes mass storage for data or instructions. As an example and not by way of limitation, storage 1506 may include a hard disk drive (HDD), a floppy disk drive, flash memory, an optical disc, a magneto-optical disc, magnetic tape, or a Universal Serial Bus (USB) drive or a combination of two or more of these. Storage 1506 may include removable or non-removable (or fixed) media, where appropriate. Storage 1506 may be internal or external to computer system 1500, where appropriate. In particular embodiments, storage 1506 is non-volatile, solid-state memory. In particular embodiments, storage 1506 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 1506 taking any suitable physical form. Storage 1506 may include one or more storage control units facilitating communication between processor 1502 and storage 1506, where appropriate. Where appropriate, storage 1506 may include one or more storages 1506. Although this disclosure describes and illustrates particular storage, this disclosure contemplates any suitable storage.

In particular embodiments, I/O interface 1508 includes hardware, software, or both, providing one or more interfaces for communication between computer system 1500 and one or more I/O devices. Computer system 1500 may include one or more of these I/O devices, where appropriate. One or more of these I/O devices may enable communication between a person and computer system 1500. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 1508 for them. Where appropriate, I/O interface 1508 may include one or more device or software drivers enabling processor 1502 to drive one or more of these I/O devices. I/O interface 1508 may include one or more I/O interfaces 1508, where appropriate. Although this disclosure describes and illustrates a particular I/O interface, this disclosure contemplates any suitable I/O interface.

In particular embodiments, communication interface 1510 includes hardware, software, or both providing one or more interfaces for communication (such as, for example, packet-based communication) between computer system 1500 and one or more other computer systems 1500 or one or more networks. As an example and not by way of limitation, communication interface 1510 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 1510 for it. As an example and not by way of limitation, computer system 1500 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 1500 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 1500 may include any suitable communication interface 1510 for any of these networks, where appropriate. Communication interface 1510 may include one or more communication interfaces 1500, where appropriate. Although this disclosure describes and illustrates a particular communication interface, this disclosure contemplates any suitable communication interface.

In particular embodiments, bus 1512 includes hardware, software, or both coupling components of computer system 1500 to each other. As an example and not by way of limitation, bus 1512 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 1512 may include one or more buses 1512, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A dehumidifier, comprising:

a cabinet;

an air diffuser configured to diffuse an airflow from the dehumidifier, the air diffuser comprising an inlet, an outlet above the inlet, and a divider between the inlet and outlet, the divider configured to prevent the airflow entering the cabinet through the inlet from mixing with the airflow exiting the cabinet from the outlet;

a compressor;

an evaporator installed within the cabinet above the compressor, the evaporator comprising a plurality of evaporator coils;

a condenser installed within the cabinet above the evaporator, the condenser comprising a plurality of micro-channel condenser coils;

a fan installed between the evaporator and a back surface of the cabinet, the fan configured to generate the airflow that flows into the cabinet through the inlet of the air diffuser and out of the cabinet through the outlet of the air diffuser, the airflow flowing through the evaporator and condenser in order to provide dehumidification to the airflow;

a drain pan installed within the cabinet below the evaporator, the drain pan configured to capture water removed from the airflow by the evaporator;

a sensor installed below the drain pan, the sensor configured to sense one or more environmental conditions of a bypass portion of the airflow; and a processor configured to:

determine a first evaporator coil temperature set point and a second evaporator coil temperature set point, wherein the first evaporator coil temperature set point is lower than the second evaporator coil temperature set point;

determine whether the dehumidifier has been operating in a dehumidifying mode for a time period less than a predetermined amount of time;

in response to determining that the dehumidifier has been operating in the dehumidifying mode for a time period less than the predetermined amount of time, compare a first measured evaporator coil temperature to the first evaporator coil temperature set point;

in response to determining that the first measured evaporator coil temperature is less than the first evaporator coil temperature set point, set the dehumidifier to a defrost mode;

in response to determining that the dehumidifier has been operating in the dehumidifying mode for a time period equal to or greater than the predetermined amount of time, determine whether a second measured evaporator coil temperature is less than the second evaporator coil temperature set point; and in response to determining that the second measured evaporator coil temperature is less than the second evaporator coil temperature set point, set the dehumidifier to the defrost mode.

2. The dehumidifier of claim 1, wherein the processor is further configured to:

in response to determining that the first measured evaporator coil temperature is equal to or greater than the first evaporator coil temperature set point, determine whether the dehumidifier has been operating in the dehumidifying mode for a time period less than the predetermined amount of time.

3. The dehumidifier of claim 1, wherein the fan and the compressor are enabled when the dehumidifier operates in the dehumidifying mode.

4. The dehumidifier of claim 1, wherein the fan is enabled and the compressor is disabled when the dehumidifier operates in the defrost mode.

5. The dehumidifier of claim 1, wherein the processor is further configured to:

determine whether a measured relative humidity is greater than a predetermined relative humidity set point;

in response to determining that the measured relative humidity is greater than the predetermined relative humidity set point, set the dehumidifier to the dehumidifying mode.

6. The dehumidifier of claim 5, wherein the processor is further configured to:

in response to determining that the measured relative humidity is equal to or less than the predetermined relative humidity set point, set the dehumidifier to a dehumidistat mode.

7. The dehumidifier of claim 6, wherein the fan and the compressor are disabled when the dehumidifier operates in the dehumidistat mode.

8. A dehumidifier, comprising:

an evaporator;

a condenser;

a fan configured to generate an airflow that flows through the evaporator and condenser in order to provide dehumidification to the airflow;

a compressor; and a processor configured to:

determine a first evaporator coil temperature set point and a second evaporator coil temperature set point, wherein the first evaporator coil temperature set point is lower than the second evaporator coil temperature set point;

determine whether the dehumidifier has been operating in a dehumidifying mode for a time period less than a predetermined amount of time;

in response to determining that the dehumidifier has been operating in the dehumidifying mode for a time period less than the predetermined amount of time, compare a first measured evaporator coil temperature to the first evaporator coil temperature set point;

in response to determining that the first measured evaporator coil temperature is less than the first evaporator coil temperature set point, set the dehumidifier to a defrost mode;

in response to determining that the dehumidifier has been operating in the dehumidifying mode for a time period equal to or greater than the predetermined amount of time, determine whether a second measured evaporator coil temperature is less than the second evaporator coil temperature set point; and in response to determining that the second measured evaporator coil temperature is less than the second evaporator coil temperature set point, set the dehumidifier to the defrost mode.

9. The dehumidifier of claim 8, wherein the processor is further configured to:

in response to determining that the first measured evaporator coil temperature is equal to or greater than the first evaporator coil temperature set point, determine whether the dehumidifier has been operating in the dehumidifying mode for a time period less than the predetermined amount of time.

10. The dehumidifier of claim 8, wherein the fan and the compressor are enabled when the dehumidifier operates in the dehumidifying mode.

11. The dehumidifier of claim 8, wherein the fan is enabled and the compressor is disabled when the dehumidifier operates in the defrost mode.

12. The dehumidifier of claim 8, wherein the processor is further configured to:

determine whether a measured relative humidity is greater than a predetermined relative humidity set point;

in response to determining that the measured relative humidity is greater than the predetermined relative humidity set point, set the dehumidifier to the dehumidifying mode.

13. The dehumidifier of claim 12, wherein the processor is further configured to:

in response to determining that the measured relative humidity is equal to or less than the predetermined relative humidity set point, set the dehumidifier to a dehumidistat mode.

14. The dehumidifier of claim 13, wherein the fan and the compressor are disabled when the dehumidifier operates in the dehumidistat mode.

15. A method, comprising:

determining a first evaporator coil temperature set point and a second evaporator coil temperature set point, the first evaporator coil temperature set point being lower than the second evaporator coil temperature set point;

determining that a dehumidifier has been operating in a dehumidifying mode for a time period less than a predetermined amount of time;

in response to determining that the dehumidifier has been operating in the dehumidifying mode for a time period less than the predetermined amount of time, determining that a first measured evaporator coil temperature is less than the first evaporator coil temperature set point; and in response to determining that the first measured evaporator coil temperature is less than the first evaporator coil temperature set point, setting the dehumidifier to a defrost mode.

16. The method of claim 15, wherein a fan and a compressor are enabled when the dehumidifier operates in the dehumidifying mode.

17. The method of claim 15, wherein a fan is enabled and a compressor is disabled when the dehumidifier operates in the defrost mode.

18. The method of claim 15, wherein the method further comprises:

determining whether a measured relative humidity is greater than a predetermined relative humidity set point;

in response to determining that the measured relative humidity is greater than the predetermined relative humidity set point, setting the dehumidifier to the dehumidifying mode.

19. The method of claim 18, wherein the method further comprises:

in response to determining that the measured relative humidity is equal to or less than the predetermined relative humidity set point, setting the dehumidifier to a dehumidistat mode.

* * * * *